US008073357B2

(12) United States Patent
Sakuma

(10) Patent No.: US 8,073,357 B2
(45) Date of Patent: Dec. 6, 2011

(54) DEVELOPER CARTRIDGE, DEVELOPING UNIT AND IMAGE FORMING APPARATUS HAVING SEAL MEMBER FOR PREVENTING LEAKAGE OF DEVELOPER

(75) Inventor: Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 129 days.

(21) Appl. No.: 12/406,209

(22) Filed: Mar. 18, 2009

(65) Prior Publication Data

US 2009/0245854 A1 Oct. 1, 2009

(30) Foreign Application Priority Data

Mar. 27, 2008 (JP) ..... 2008-082966

(51) Int. Cl.
*G03G 15/08* (2006.01)

(52) U.S. Cl. ..... 399/106

(58) Field of Classification Search ..... 399/103, 399/105, 106, 262; 222/DIG. 1
See application file for complete search history.

(56) References Cited

U.S. PATENT DOCUMENTS

| | | | | |
|---|---|---|---|---|
| 5,548,384 | A * | 8/1996 | Weed | 399/120 |
| 5,722,019 | A * | 2/1998 | Nakajima | 399/262 |
| 5,890,034 | A * | 3/1999 | Nakano et al. | 399/106 |
| 6,438,345 | B1 * | 8/2002 | Ban et al. | 399/262 |
| 2007/0104505 | A1 * | 5/2007 | Murakami et al. | 399/106 |
| 2007/0223963 | A1 | 9/2007 | Suzuki et al. | |
| 2007/0223964 | A1 | 9/2007 | Takagi | |
| 2007/0223965 | A1 | 9/2007 | Takagi | |
| 2007/0223971 | A1 | 9/2007 | Takagi | |
| 2008/0267658 | A1 * | 10/2008 | Takagi et al. | 399/106 |
| 2009/0087215 | A1 * | 4/2009 | Sakuma | 399/105 |
| 2009/0087216 | A1 * | 4/2009 | Sakuma | 399/106 |
| 2009/0245855 | A1 * | 10/2009 | Sakuma | 399/106 |

FOREIGN PATENT DOCUMENTS

| | | | |
|---|---|---|---|
| CN | 1269533 | A | 10/2000 |
| JP | 2000-347493 | | 12/2000 |
| JP | 2001-194884 | | 7/2001 |
| JP | 2001-331026 | | 11/2001 |
| JP | 2007-072234 | A | 3/2007 |
| JP | 2007-101705 | A | 4/2007 |
| JP | 2007-293268 | | 11/2007 |

OTHER PUBLICATIONS

JP Office Action dtd Feb. 23, 2010, JP Appln. 2008-082966, English Translation.
CN Office Action dtd Jan. 25, 2011, CN Appln. 200910127941.0, English translation.

* cited by examiner

*Primary Examiner* — Robert Beatty
(74) *Attorney, Agent, or Firm* — Banner & Witcoff, Ltd.

(57) ABSTRACT

A developer cartridge includes a first frame and a second frame that confronts the first frame. The second frame includes an opening, through which developer is passed, and which is openable and closable by the first frame in accordance with a relative movement between the second frame and the first frame, a seal member, which is provided around the opening for preventing leakage of the developer from the opening, and which comprises a seal side confronting portion confronting the first frame when the second frame moves relative to the first frame, and a protection member, which has an elastic modulus higher than an elastic modulus of the seal member, and which is provided between the seal side confronting portion of the seal member and the first frame for protecting the seal member.

11 Claims, 16 Drawing Sheets

UP
LO
RE
LE
RI
FR
17

17

31

31

DEVELOPER CARTRIDGE, DEVELOPING UNIT AND IMAGE FORMING APPARATUS HAVING SEAL MEMBER FOR PREVENTING LEAKAGE OF DEVELOPER

CROSS-REFERENCE TO RELATED APPLICATIONS

This application claims priority from Japanese Patent Application No. 2008-082966 filed on Mar. 27, 2008, the entire subject matter of which is incorporated herein by reference.

TECHNICAL FIELD

Aspects of the invention relate to a developer cartridge for accommodating developer, a developing unit and an image forming apparatus.

BACKGROUND

There has been proposed a developer cartridge, which accommodates developer, and which is mounted to an image forming apparatus such as a laser printer and to a developing unit of the image forming apparatus.

As an example of a related art developer cartridge, JP-A-2007-293268 discloses a toner box having a double structure including an inside housing for accommodating toner and an outside housing for accommodating the inside housing in such a manner as to rotate freely therein. The toner box is installed in a process unit of a laser printer.

In the toner box, the outside housing includes a first toner discharge opening, and the inside housing includes a second toner discharge opening. In the toner box, the inside housing is rotated relative to the outside housing (i.e., relative movement) so that the first toner discharge opening and the second toner discharge opening are made to confront each other for enabling communication between the first toner discharge opening and the second toner discharge opening in order to supply toner from the inside housing to the process unit.

In the toner box, first radial projections formed of an elastic material are provided around the second toner discharge opening on an external surface of the inside housing. When the second toner discharge opening is opened, the first radial projections are exposed partially from the first toner discharge opening to be brought into contact with the process unit. According thereto, the first radial projections can hold a space between the process unit and the inside housing airtight and fluid-tight. Therefore, a toner leakage from the second toner discharge opening may be prevented. That is, in the toner box, the first radial projections function as a seal member.

SUMMARY

The related art developer cartridge described above has some disadvantages. For example, in the toner box of JP-A-2007-293268, when the inside housing moves relative to the outside housing, the first radial projections move relative to the outside housing together with the inside housing. As this occurs, a part of the first radial projections confronting the outside housing (for example, portions which bound the first toner discharge openings) may be brought into hard contact with the outside housing. Thus, the first radial projections may be damaged.

Therefore, illustrative aspects of the invention provide a developer cartridge including a first frame and a second frame, in which, when an opening of the second frame is opened and closed by relative movement between the first frame and the second frame, a seal member provided on the second frame for preventing leakage of developer from the opening can be prevented from being damaged, as well as a developing unit and an image forming apparatus to which the developer cartridge is mounted.

According to one aspect of the invention, there is provided a developer cartridge comprising: a first frame; and a second frame, which confronts the first frame, and which comprises: an opening, through which developer is passed, and which is openable and closable by the first frame in accordance with a relative movement between the second frame and the first frame; a seal member, which is provided around the opening for preventing leakage of the developer from the opening, and which comprises a seal side confronting portion confronting the first frame when the second frame moves relative to the first frame; and a protection member, which has an elastic modulus higher than an elastic modulus of the seal member, and which is provided between the seal side confronting portion of the seal member and the first frame for protecting the seal member.

According to another aspect of the invention, there is provided a developing unit comprising: a developer cartridge comprising: a first frame; and a second frame, which confronts the first frame, and which comprises: an opening, through which developer is passed, and which is openable and closable by the first frame in accordance with a relative movement between the second frame and the first frame; a seal member, which is provided around the opening for preventing leakage of the developer from the opening, and which comprises a seal side confronting portion confronting the first frame when the second frame moves relative to the first frame; and a protection member, which has an elastic modulus higher than an elastic modulus of the seal member, and which is provided between the seal side confronting portion of the seal member and the first frame for protecting the seal member, wherein the developing unit visualizes an electrostatic latent image with the developer in the developer cartridge.

According to still another aspect of the invention, there is provided an image forming apparatus comprising: a developer cartridge comprising: a first frame; and a second frame, which confronts the first frame, and which comprises: an opening, through which developer is passed, and which is openable and closable by the first frame in accordance with a relative movement between the second frame and the first frame; a seal member, which is provided around the opening for preventing leakage of the developer from the opening, and which comprises a seal side confronting portion confronting the first frame when the second frame moves relative to the first frame; and a protection member, which has an elastic modulus higher than an elastic modulus of the seal member, and which is provided between the seal side confronting portion of the seal member and the first frame for protecting the seal member; and an image forming apparatus main body to which the developer cartridge is mounted.

According to the aspects of the invention, in this developer cartridge, the opening formed in the second frame, which is provided so as to confront the first frame, is closed by the first frame through the relative movement of the first frame and the second frame. When the opening is opened, the passage of developer through the opening is permitted, while when the opening is closed, the passage of developer through the opening is restricted. In addition, the leakage of the developer from the opening in the second frame is prevented by the seal member provided around the opening.

Here, since the seal member is provided on the second frame, on the seal member, there exists the seal side confronting portion which confront the first frame when the second frame moves relative to the first frame. Thus, when the second frame moves relative to the first frame, the seal side confronting portion may be brought into hard contact with the first frame, and the seal member may be damaged at the seal side confronting portion.

However, the protection member having the higher elastic modulus (i.e., higher robustness) than the seal member is provided on the second frame. In addition, when the second frame moves relative to the first frame, by this projection member being provided between the seal side confronting portion and the first frame, the contact of the seal side confronting portion with the first frame is prevented, thus the seal member being protected.

As a result, the damage to the seal member at the seal side confronting portion can be prevented when the second frame moves relative to the first frame.

BRIEF DESCRIPTION OF THE DRAWINGS

FIGS. 12A and 12B are cross sectional views of a developer cartridge according to a reference example as viewed from a left side, in which FIG. 12A shows a state in which an inside housing is in an opening position, and FIG. 12B shows a state in which the inside housing is moved halfway from the opening position to a closing position, specifically, a state in which a lower circumferential edge of a developer seal is brought into contact with an upper contact portion of an outside housing from a lower side;

DETAILED DESCRIPTION

Exemplary embodiments of the invention will now be described with reference to the drawings.

(Image Forming Apparatus)

Figure 1:
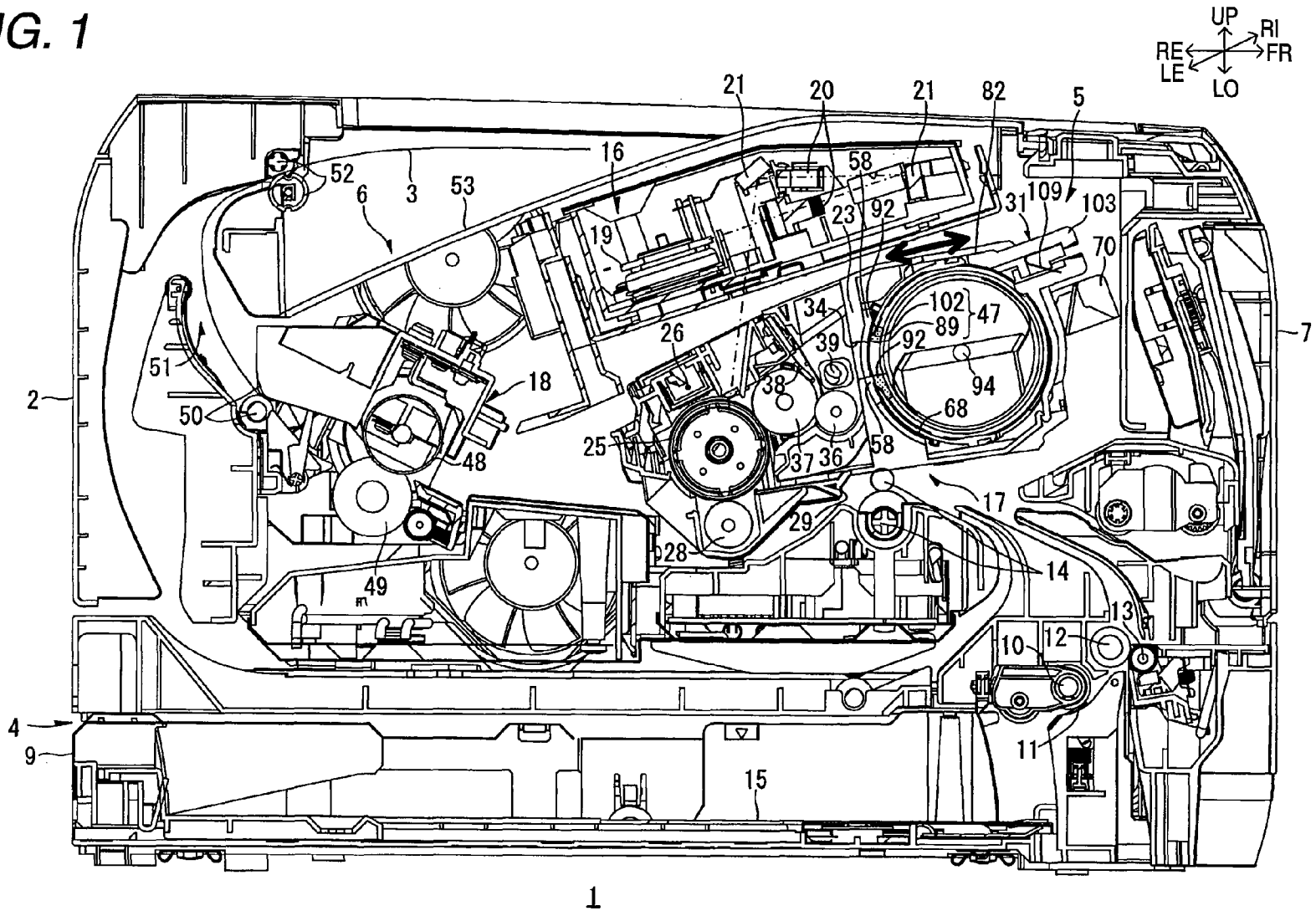
FIG. 1 is a left side sectional view of an image forming apparatus according to an exemplary embodiment of the invention.
Figures 2A, 2B:
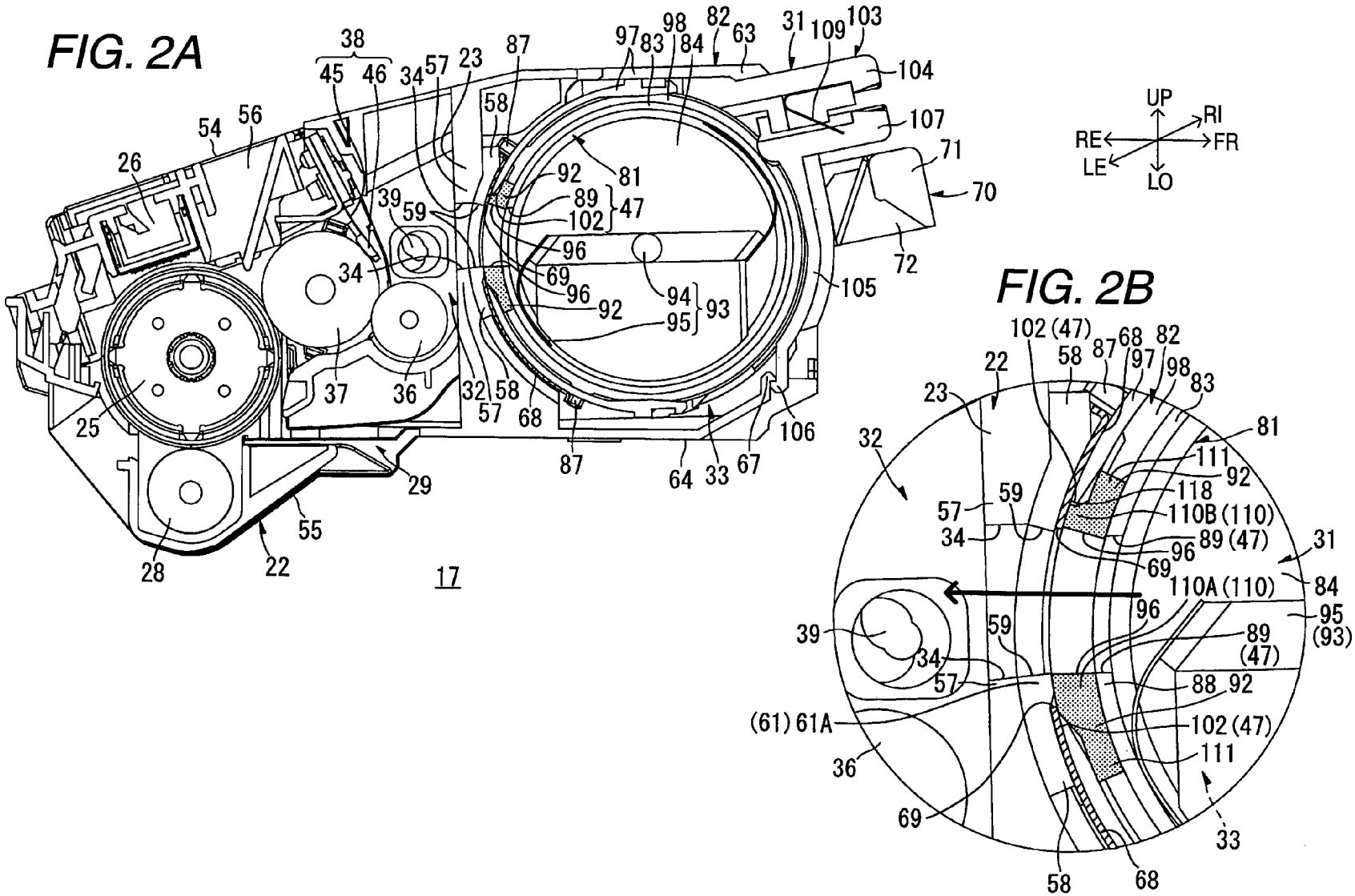
FIG. 2A is a left side sectional view of a process cartridge of the image forming apparatus shown in FIG. 1, wherein the process cartridge is in a state in which a developer cartridge is mounted and a swing arm is at a pressing position.
FIG. 2B is a partial enlarged view of FIG. 2A.

Referring to FIGS. 1 to 2B, an image forming apparatus 1 will be described.

As shown in FIG. 1, the image forming apparatus 1 includes a feeder unit 4 for feeding sheets 3, an image forming unit 5 for forming an image on a sheet 3 so fed and a sheet discharging part 6 for discharging the sheet 3 on which the image is formed in a body casing 2 as an example of an image forming apparatus main body. Incidentally, a laser printer is one example of the image forming apparatus 1.

(1) Body Casing

The body casing 2 has a substantially box shape. The body casing 2 includes an opening in a side wall on one of sides thereof and a front cover 7 for opening and closing the opening. A process cartridge 17 (which will be described later) (an example of a developing unit) can be mounted to and removed from the body casing 2 along directions indicated by thick arrows shown in FIG. 1 by opening the front cover 7.

Note that, in the following description, the side where the front cover 7 is provided is referred to as a front side (i.e., a front elevation side) and an opposite side to the side is referred to as a rear side (i.e., a back side). In addition, a near side of FIG. 1 in a paper thickness direction is referred to as a left side, and a far side of FIG. 1 in the paper thickness direction is referred to as a right side. A left-right or transverse direction mean a width direction. A substantially horizontal direction is included in a front-rear or longitudinal direction and the transverse direction. In addition, in the description of the process cartridge 17 which will be described later and a developer cartridge 31 as an example of a developer cartridge, a state is referred to as a reference state in which frame side passage openings 34 (which will be described later) and cartridge side passage openings 47 (which will be described later) confront each other along the substantially horizontal direction (i.e., the longitudinal direction).

(2) Feeder Unit

The feeder unit 4 includes a sheet feeding tray 9, a feed roller 10, a feed pad 11, paper dust collecting rollers 12 and 13, registration rollers 14 and a sheet pressing plate 15. A sheet 3 stacked in the sheet pressing plate 15 is fed out sheet one at a time by the feed roller 10 and the feed pad 11. After passing through the various types of rollers (i.e., paper duct collecting rollers 12 and 13 and registration rollers 14), the sheet 3 is conveyed to a transfer position (which will be described later) in the image forming unit 5.

(3) Image Forming Unit

The image forming unit 5 includes a scanner unit 16, a process cartridge 17 and a fixing part 18.

(3-1) Scanner Unit

The scanner unit 16 is provided at an upper portion inside the body casing 2. The scanner unit 16 includes a laser emitting member (not shown), a polygon mirror 19 which is driven to rotate, a plurality of lenses 20 and a plurality of reflecting mirrors 21. A laser beam emitted from the laser emitting member based on image data is reflected by the polygon mirror 19, passes through the plurality of lenses 20 and is reflected by the plurality of reflecting mirrors 21 as indicated by an alternate long and short dash line, so as to be scanned over a surface of a photosensitive drum 25 (which will be described later).

(3-2) Process Cartridge

The process cartridge 17 is accommodated in a space below the scanner unit 16 in the body casing 2. The process cartridge 17 is mounted to and removed from the body casing 2.

As shown in FIGS. 2A and 2B, the process cartridge 17 includes a hollow process frame 22 and the developer cartridge 31. A transfer path 29 is formed in the process frame 22 for permission of passage of a sheet 3. The developer cartridge 31 is removably mounted to a cartridge holding part 33 in the process frame 22.

In the process frame 22, a partition wall 23 is provided in a substantially central position in the longitudinal direction thereof so as to extend in an up-down or vertical direction. In an inner space of the process frame 22, a portion at the rear of the partition wall 23 is referred to as a developing part 32, and a portion at the front of the partition wall 23 is referred to as the cartridge holding part 33. Frame side passage openings 34 are formed in the partition wall 23. The developing part 32 and the cartridge holding part 33 are made to communicate with each other by the frame side passage openings 34.

The developing part 32 holds the photosensitive drum 25, a scorotron-type charger 26, a transfer roller 28, a supply roller 36, a developing roller 37, a layer thickness restriction blade 38 and an auger 39. Here, the photosensitive drum 25, the transfer roller 28, the supply roller 36, the developing roller 37 and the auger 39 are supported rotatably on the process frame 22.

The scorotron-type charger 26 is supported on the process frame 22 above the photosensitive drum 25 so as to be spaced a certain interval apart from the photosensitive drum 25. The transfer roller 28 confronts the photosensitive drum 25 from a lower side of the photosensitive drum 25. The developing roller 37 confronts the photosensitive drum 25 from a front side of the photosensitive drum 25. The supply roller 36 confronts the developing roller 37 from a front side of the developing roller 37. The layer thickness restriction blade 38 includes a plate spring member 45 of a thin plate shape which is fixed to the process frame 22 at an upper end thereof and a press contact rubber 46 which presses against a surface of the developing roller 37 by virtue of an elastic force of the plate spring member 45. The auger 39 includes a shank which extends along the width direction and a spiral vane formed on an outer surface of the shank and is provided above the supply roller 36 and adjacent to the rear of the frame side passage openings 34.

The developer cartridge 31 is removably mounted to the process frame 22 and is held in the cartridge holding part 33 when so mounted. The developer cartridge 31 has a substantially cylindrical shape. Cartridge side passage openings 47 are formed in the developer cartridge 31 so as to establish a communication between an outside and an inside of the developer cartridge 31.

An agitator 93 is provided rotatably in the developer cartridge 31. In addition, positively chargeable, non-magnetic one component toner as an example of developer is accommodated in the developer cartridge 31. An average grain size (i.e., diameter) of the developer is in the range of about 6 to 10 μm.

The developer in the developer cartridge 31 is stirred by the rotating agitator 93, is received by the frame side passage openings 34 from the cartridge side passage openings 47, and is then discharged into an interior of the developing part 32. The discharged developer is conveyed in the width direction by the vane of the rotating auger 39 and is made to fall in the midst thereof so as to be supplied to the supply roller 36.

The developer supplied to the supply roller 36 is supplied to the developing roller 37 by the rotating supply roller 36. As this occurs, the developer is friction charged to a positive polarity between the supply roller 36 and the developing roller 37. Following this, the developer supplied to the developing roller 37 enters between the press contact rubber 46 and the developing roller 37 in accordance with rotation of the developing roller 37 and is carried on a surface of the developing roller 37 in the form of a thin layer while a layer thickness is being restricted between the press contact rubber 46 and the developing roller 37. Note that the developer is friction charged to the positive polarity also when it enters between the press contact rubber 46 and the developing roller 37.

In addition, firstly, the surface of the photosensitive drum 25 is uniformly charged positively by the scorotron-type charger 26 in accordance with rotation of the photosensitive drum 25 and is thereafter exposed by a laser beam from the scanner unit 16. By this series of actions, an electrostatic latent image based on image data is formed on the surface of the photosensitive drum 25. When the developer is made to confront and contact with the photosensitive drum 25 in accordance with rotation of the developing roller 37, developer carried on the surface of the developing roller 37 is supplied to the electrostatic latent image formed on the surface of the photosensitive drum 25. By this action, the electrostatic latent image is developed (i.e., visualized), and a developer image is carried on the surface of the photosensitive drum 25. The developer image is transferred on to a sheet 3 which has been supplied between the photosensitive drum 25 and the developing roller 37 (i.e., a transfer position).

(3-3) Fixing Part

As shown in FIG. 1, the fixing part 18 is provided at the rear of the process cartridge 17. The fixing part 18 includes a heating roller 18, a pressure roller 49 which is brought into press contact with the heating roller 48 from a lower side thereof, and a pair of conveyance rollers 50 provided rearward of the rollers.

In the fixing part 18, the developer transferred on to the sheet 3 in the transfer position is thermally fixed while the sheet 3 is passing through the heating roller 48 and the pressure roller 49. Thereafter, the sheet 3 is conveyed to the sheet discharging part 6 by the pair of conveyance rollers 50.

(4) Sheet Discharging Part

The sheet discharging part 6 includes a sheet discharging path 51, discharge rollers 52 and a sheet discharging tray 53. The sheet 3 conveyed from the fixing part 18 to the sheet discharging part 6 is conveyed from the sheet discharging path 51 to the discharge rollers 52 and is then discharged on to the sheet discharging tray 53 by the discharge rollers 52.

(Process Cartridge)

Referring to FIGS. 3A to 6, the process cartridge 17 will be described.

(1) Process Frame

Figures 3A, 3B:
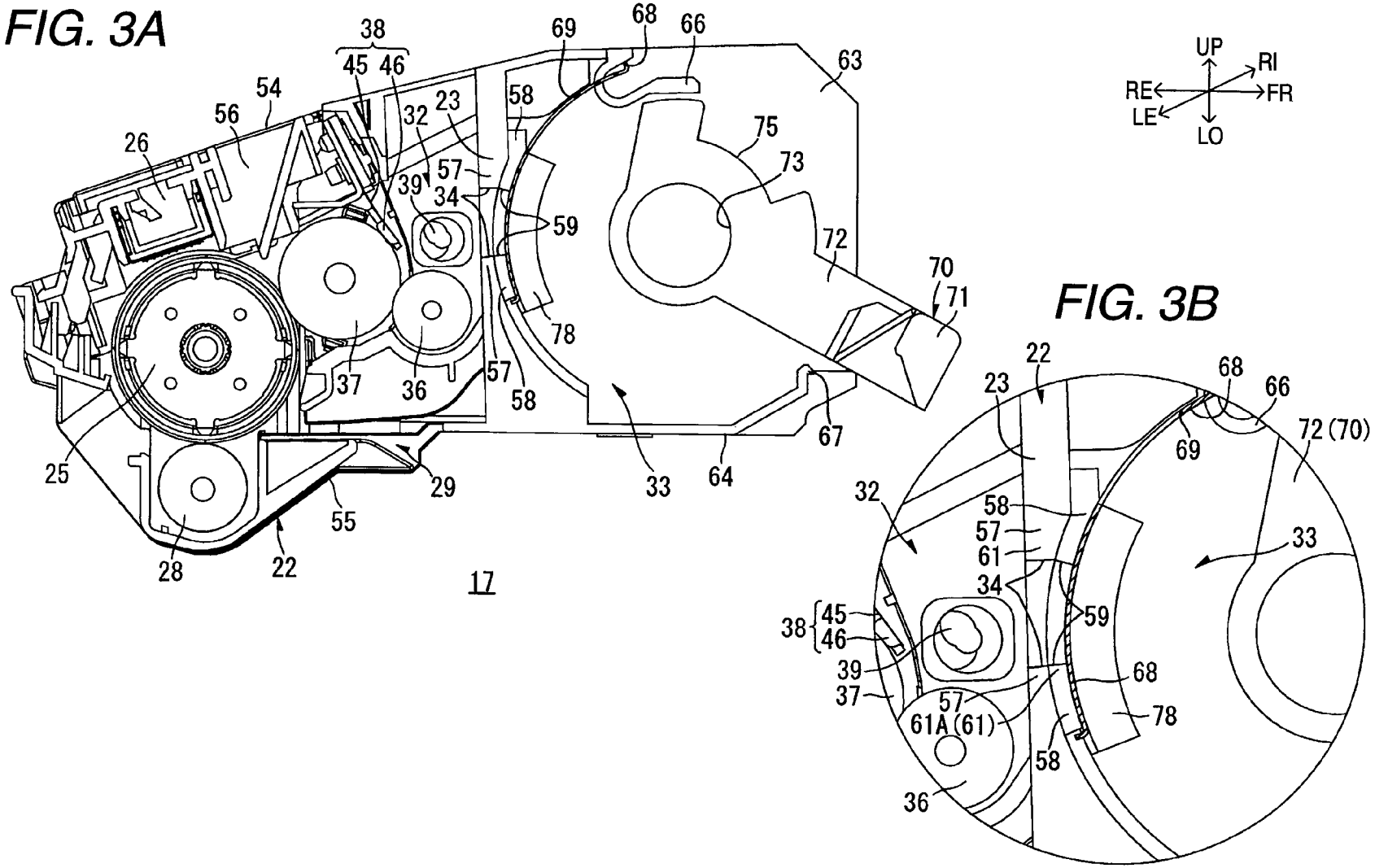
FIG. 3A is a left side sectional view of the process cartridge of the image forming apparatus shown in FIG. 1, wherein the process cartridge is in a state in which the developer cartridge is removed and a swing arm is at a pressing releasing position.
FIG. 3B is a partial enlarged view of FIG. 3A.

As shown in FIGS. 3A and 3B, the process frame 22 of the process cartridge 17 includes the developing part 32 and the cartridge holding part 33.

(1-1) Developing Part

Figure 4:
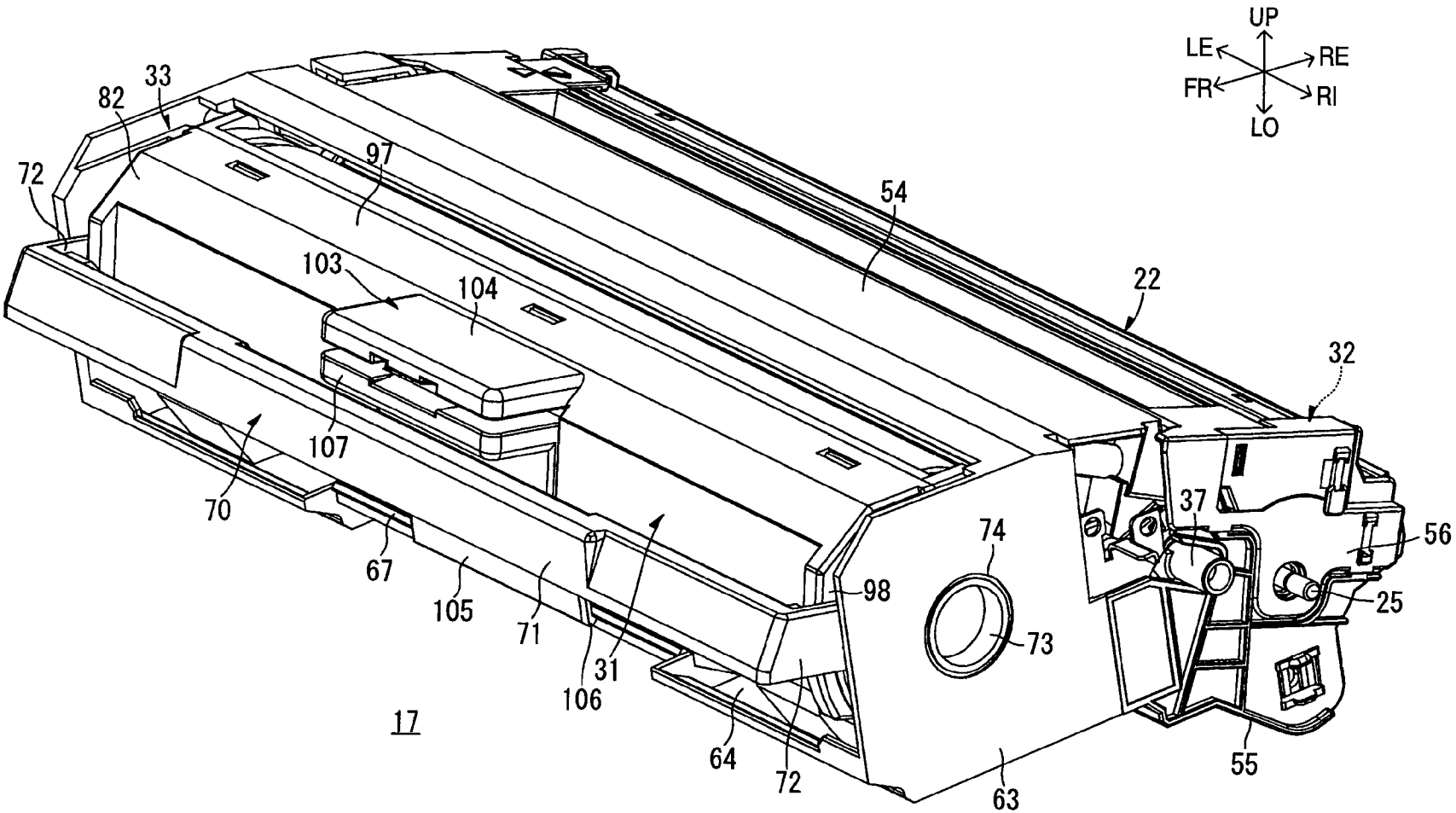
FIG. 4 is a perspective view of the process cartridge shown in FIG. 2A as viewed from a right front side.

As shown in FIGS. 3 and 4, the developing part 32 is a space defined by an upper wall 54, a bottom wall 55, both side walls 56 and the partition wall 23 that has been described above. The side walls 56 extend along the longitudinal direction. The side walls 56 confront each other with a predetermined space therebetween in the width direction.

Figure 6:
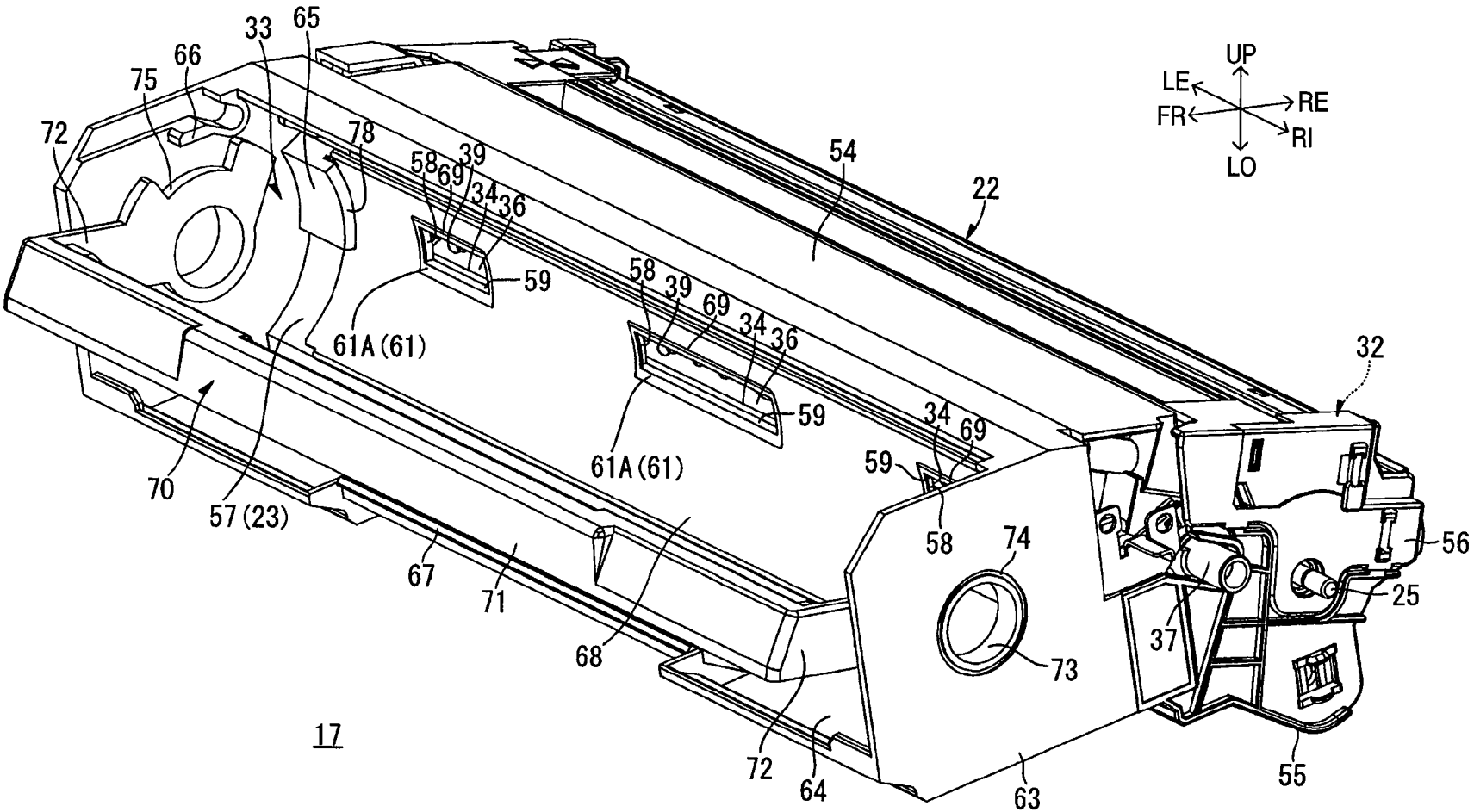
FIG. 6 is a perspective view of the process cartridge shown in FIG. 4, in which the developer cartridge is omitted.

As shown in FIGS. 2A and 2B, a curved portion 57 is formed halfway upwards or downwards the partition wall 23. A front surface of the curved portion 57 is smoothly recessed to the rear in such a manner as to follow an outer circumferential surface of the developer cartridge 31. The frame side passage openings 34 are formed in the curved portion 57. As shown in FIG. 6, specifically, three frame side passage openings 34 are formed at predetermined intervals in the width direction. Each frame side passage opening 34 has a substantially rectangular shape which is elongated in the width direction and is made to face the cartridge holding part 33.

As shown in FIGS. 3A and 3B, a frame seal 58 is stuck to the front surface of the curved portion 57 to prevent the leakage of developer from the frame side passage openings 34 into the cartridge holding part 33.

The frame seal 58 is made of a foamed material and has a belt-like shape which extends in the width direction. As shown in FIG. 6, three cut-out portions 59 are formed in the frame seal 58 at predetermined intervals in the width direction in such a manner as to correspond respectively to the frame side passage openings 34. Each cut-out portion 59 is a through hole having substantially the same size as the frame side passage opening 34 and is made to confront the corresponding frame side passage opening 34 from a front side thereof for communication therewith. In this state, the frame seal 58 is provided to surround the frame side passage openings 34 in such a manner that the cut-out portions 59 surround the corresponding frame side passage openings 34 while protruding towards an interior of the cartridge holding part.

(1-2) Cartridge Holding Part

Figure 5:
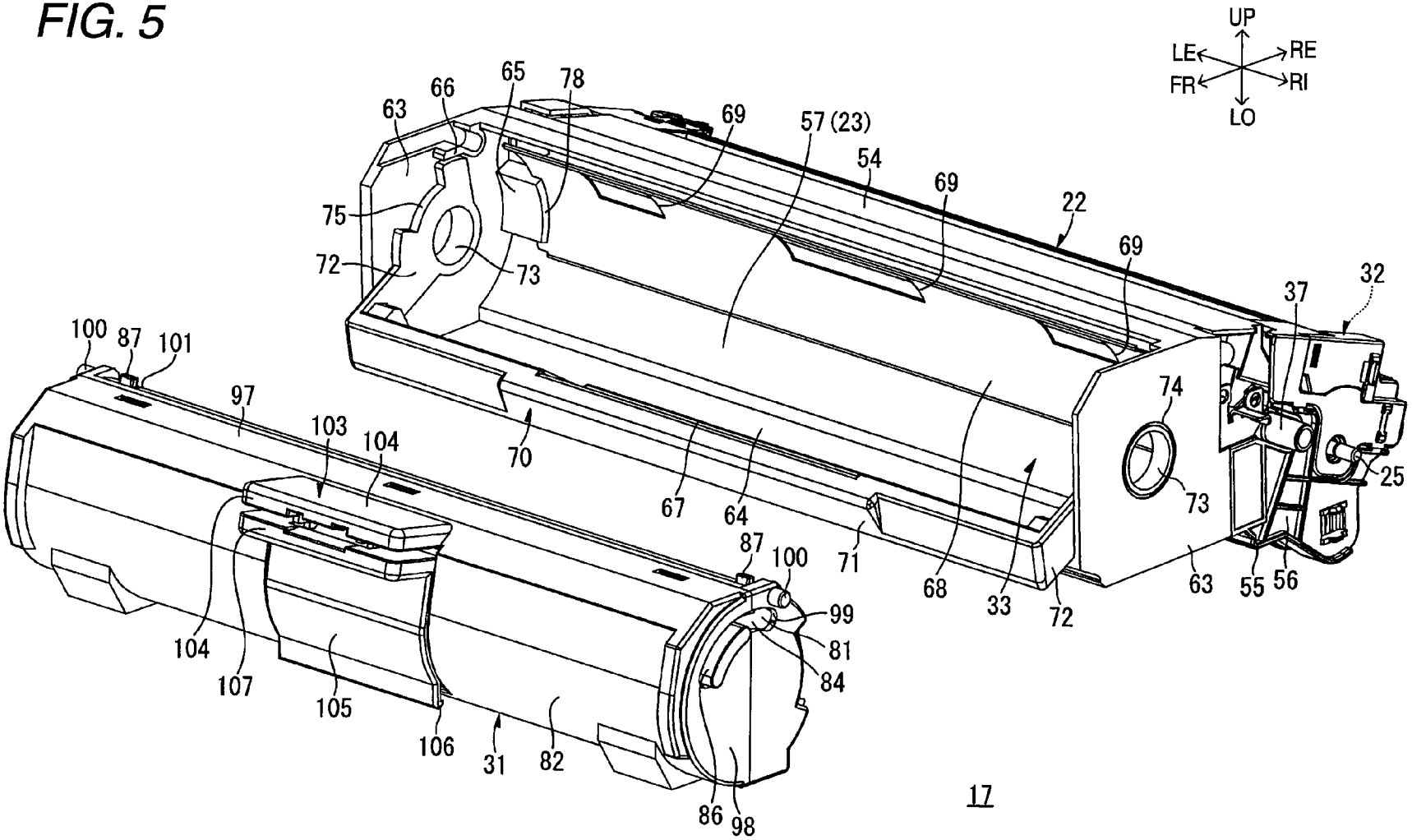
FIG. 5 is a schematic perspective view of the process cartridge as viewed from the right front side.

As shown in FIG. 5, the cartridge holding part 33 is a space defined by both side plates 63, a bottom plate 64 and the partition wall 23. The side plates 63 continue to the corresponding side walls 56 in the developing part 32, and the bottom plate 64 continues to the bottom wall 55 of the developing part 32.

A shutter supporting portion 65 is provided on an inner surface of each of the side plates 63 in the width direction. The shutter supporting portion 65 has a rectangular parallelepiped shape having an arc-like cross section when viewed from the width direction and swells inwards from the inner surface of the side plate 63 in the width direction.

A shutter guide portion 78 is provided on an inner surface of the shutter supporting portion 65 in the width direction. The shutter guide portion 78 is formed into an elongated projection which swells inwards from the inner surface of the shutter supporting portion 65 in the width direction and is provided in such a manner as to confront the curved portion 57 of the partition wall 23 with a slight space provided therebetween in the longitudinal direction. The shutter guide portion 78 has a curved shape having substantially the same radius of curvature as the curved portion 57.

An upper fixing portion 66 is provided on the inner surface of each of the side plates 63 in the width direction. The upper fixing portion 66 has a substantially U-shape which is recessed obliquely rearwards and downwards as viewed from the width direction and swells inwards from the inner surface of the side plate 63 in the width direction. A lower fixing portion 67 is formed at a center in the width direction of a front end of the bottom plate 64 in such a manner as to project slightly forwards (refer to FIG. 3A).

A shutter 68 is provided in the cartridge holding part 33 to open and close the frame side passage openings 34.

The shutter 68 has a substantially rectangular shape which extends in the width direction while having a curved shape having substantially the same radius of curvature as the curved portion 57 of the partition wall 23. The shutter 68 is formed in such a manner as to extend between the respective shutter guide portions 78 in the width direction and to extend longer then the respective shutter guide portions 78 in the vertical direction. Three shutter openings 69 are formed in the shutter 68 at predetermined intervals in the width direction in such a manner as to correspond respectively to the frame side passage openings 34.

As shown in FIGS. 3A and 3B, the shutter 68 is provided in such a manner as to confront the curved portion 57 to which the frame seal 58 is stuck from a front side of the curved portion 57, and both end portions of the shutter 68 in the width direction are held slidably between the curved portion 57 and the respective shutter guide portions 78.

By this configuration, the shutter 68 is supported in such a manner as to swing vertically along the respective shutter guide portions 78 between an opening position (refer to FIGS. 2A, 2B and 6) where the frame side passage openings 34 are opened and a closing position (refer to FIGS. 3A, 3B and 5) where the frame side passage openings 34 are closed.

To describe this in detail, a position is the closing position which is taken by the shutter 68 when the shutter 68 is moved a predetermined distance upwards from the opening position.

As shown in FIGS. 2A and 2B, when the shutter 68 stays in the opening position, the frame side passage openings 34 and the cut-out portions 59 are made to confront the corresponding shutter openings 69 for communication therewith and are made to open to an outside (i.e., the front side) (refer to FIG. 6). As this occurs, portions of the frame seal 58 closed to the cut-out portions 59 are compressed between the curved portion 57 of the partition wall 23 and the shutter 68 in such a manner as to surround the frame side passage openings 34 and the shutter openings 69 therebetween. By this configuration, the developer is prevented from leaking from the frame side passage openings 34 and the shutter openings 69 which are in a communicating state to a gap defined between the curved portion 57 and the shutter 68.

When the shutter 68 stays in the closing position, as shown in FIGS. 3A and 3B, the frame side passage openings 34 and the cut-out portions 59 are closed from a front side thereof by a portion of the shutter 68 which lies lower than the shutter openings 69.

In addition, as shown in FIG. 5, a wing arm 70 is provided in the cartridge holding part 33. The swing arm 70 has a substantially U-shape as viewed from the top. The swing arm 70 includes integrally a grip rod 71 which extends in the width direction and arm side plates 72 which extend rearwards from both end portions in the width direction of the grip rod 71.

A boss 73 is provided at a rear end portion of each arm side plate 72 in such a manner as to project outwards in the width direction. Each boss 73 is supported rotatably in a round hole 74 formed in the corresponding side plate 63.

In addition, a receiving recessed portion 75 is formed at an upper edge of the rear end portion of each arm side plate 72 in such a manner as to be cut out to be depressed downwards.

The swing arm 70 swings on the respective bosses 73 of the arm side plates 72 as fulcrums between a pressing releasing position (refer to FIGS. 3A and 5) where lower ends of the arm side plates 72 are brought into contact with the front end of the bottom plate 64 and a pressing position (refer to FIGS. 2A, 4 and 6) where the swing arm 70 presses against the developer cartridge 31 from a front side thereof when the developer cartridge 31 is held in the cartridge holding part 33.

(2) Developer Cartridge

Referring to FIGS. 7A to 11B, the developer cartridge 31 will be described.

As shown in FIGS. 7A to 11B, the developer cartridge 31 includes an inside housing 81 as an example of a second frame which accommodates the developer and an outside housing 82 as an example of a first frame which accommodates the inside housing 81 (in other words, which is provided on an outside of the inside housing 81).

(2-1) Inside Housing

Figures 7A, 7B:
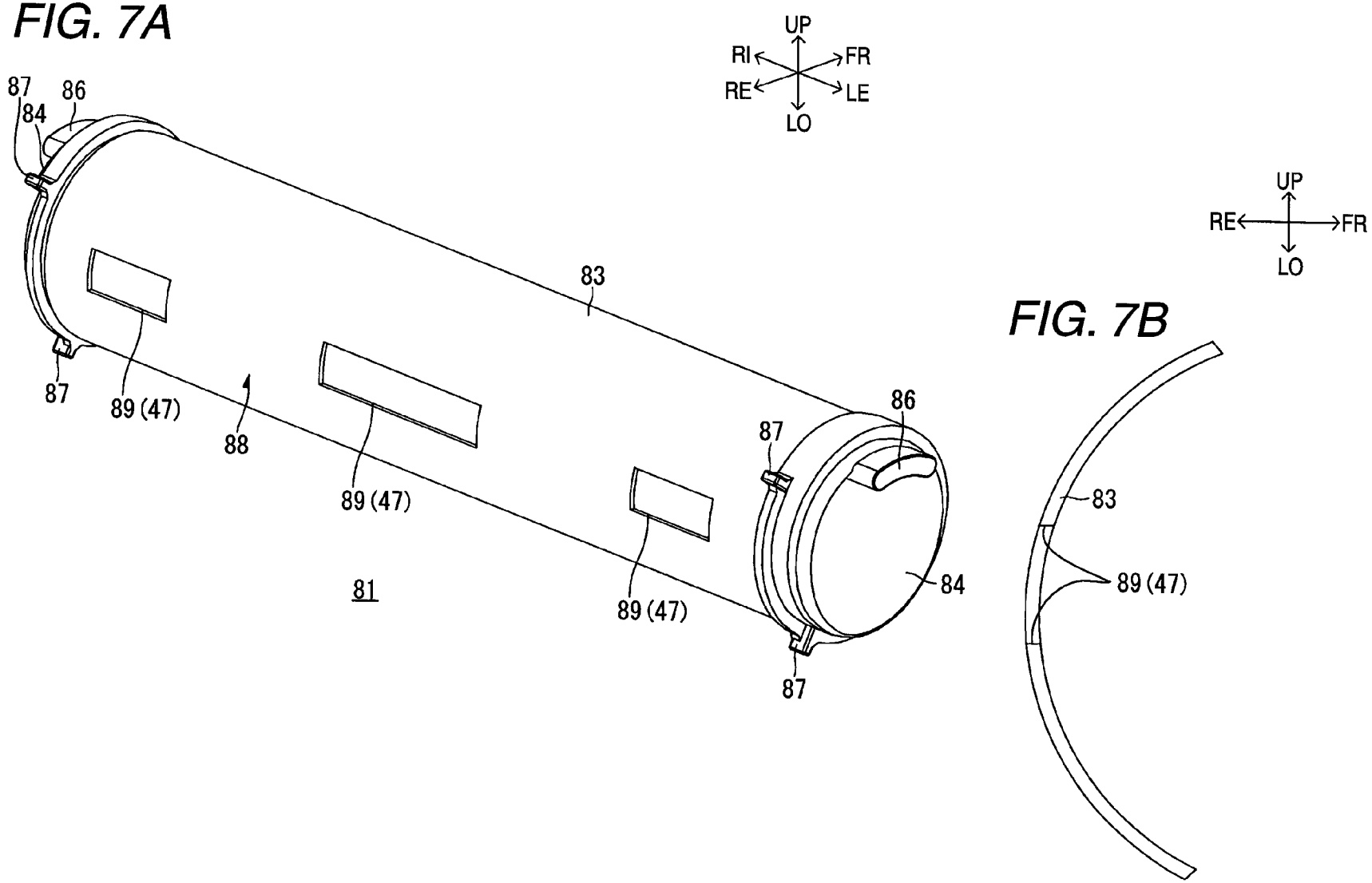
FIG. 7A is a perspective view of an inside housing of the developer cartridge as obliquely viewed from a left rear side, showing a state resulting before developer seals are stuck.
FIG. 7B is a side sectional view, at an inner passage opening, of a main part of the inside housing shown in FIG. 7A.

As shown in FIG. 7A, the inside housing 81 includes integrally a cylindrical inner circumferential wall 83 which extends in the width direction and a pair of disk-like inner side walls 84 which close end portions in the width direction of the inner circumferential wall 83, respectively. Hereinafter, unless mentioned particularly otherwise, the description will be made based on a state as a reference in which inner passage openings 89 as an example of openings which will be described later are oriented to the rear.

A sliding projection 86 is provided in one circumferential location (i.e., an upper end portion in FIG. 7A) on a circumferential edge portion of the inner side wall 84. The sliding projection 86 has an arc shape as viewed from a side which follows an outer circumferential surface of the inner side wall 84 and is provided in such a manner as to project outwards in the width direction from the inner side wall 84.

A pair of holding projections 87 is provided on a rear portion of the inner side wall 84 in such a manner as to project radially from a circumferential end face thereof and is provided in such a manner as to project outwards in the width direction from the inner side wall 84. The pair of holding projections 87 is provided on the circumferential end face of the inner side wall 84 in such a manner as to be spaced a predetermined distance (i.e., a distance equal to a circumferential length of the shutter 68) a part from each other in a circumferential direction.

Inner passage openings 89, which are a part of cartridge side passage openings 47, are formed in the inner circumferential wall 83 in a surrounded portion 88 which is surrounded by the pairs of holding projections 87 (i.e., four holding projections 87).

The inner passage opening 89 has a substantially rectangular shape which is elongated in the width direction as viewed from a back side thereof, and specifically speaking, three inner passage openings 89 are formed at predetermined intervals in the width direction in such a manner as to correspond respectively to the three frame side passage openings 34 (refer to FIG. 6). When a forming an image, the inner passage openings 89 are made to confront the frame side passage openings 34 (refer to FIG. 6) and the shutter openings 69 in the shutter 68 (refer to FIG. 6) which are situated in corresponding positions in the width direction.

Figure 8B:
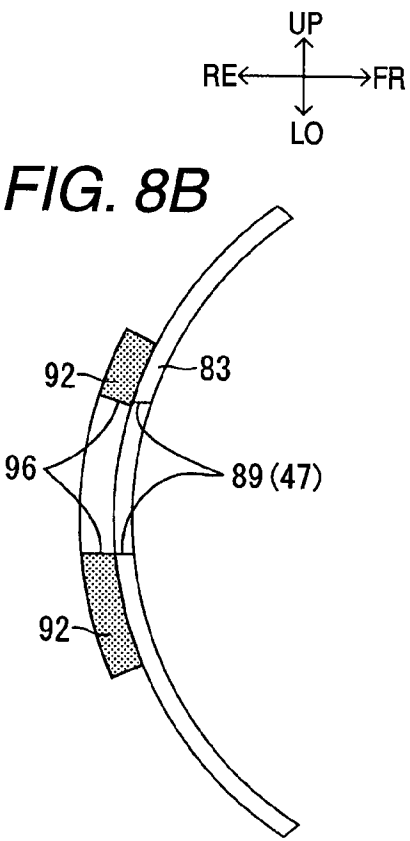
FIG. 8B shows a state in which the developer seals are stuck in FIG. 7B.
Figure 8A:
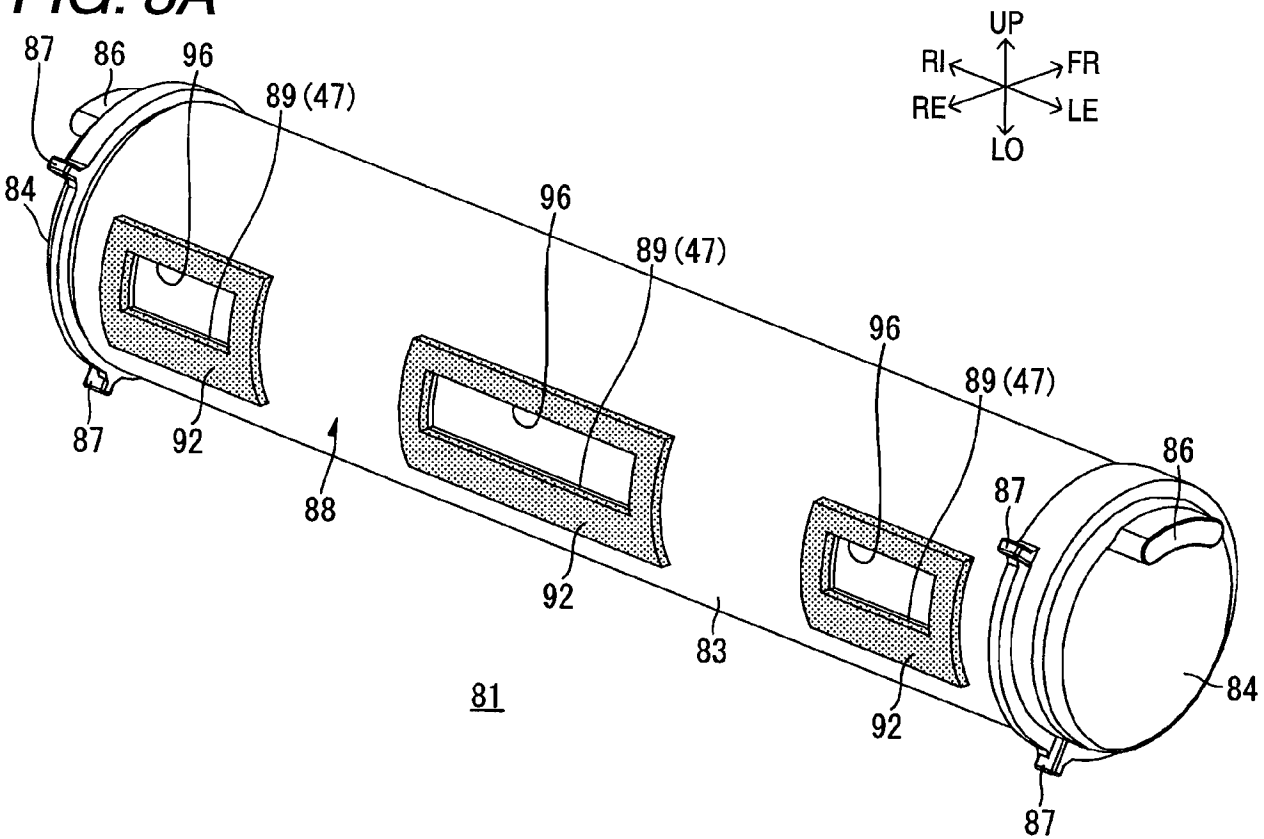
FIG. 8A shows a state in which the developer seals are stuck in FIG. 7A.

As shown in FIG. 8A, three developer seals 92 (i.e., portions shaded with dots) are stuck to an outer surface of the surrounded portion 88 in such a manner as to correspond respectively to the inner passage openings 89 for preventing the leakage of the developer from the inner passage openings 89. The developer seals 92 function as an example of a seal member. The developer seal 92 is made of a foamed material having elasticity (Poron: Trade name of the ROGERS INOAC Corporations) and has a rectangular shape which is elongated in the width direction as viewed from a back side thereof and a belt-like shape which has a substantially uniform length in the longitudinal direction (i.e., thickness).

A cut-out portion 96 is formed in a substantially central position of the developer seal 92 as viewed from the back side thereof in such a manner as to penetrate through the developer seal 92 in the longitudinal direction and to correspond to the inner passage opening 89. The cut-out portion 96 has a substantially rectangular shape as viewed from a back side thereof which has substantially the same size as that of the corresponding inner passage opening 89 and is made to confront the corresponding inner passage opening 89. In this way, the developer seals 92 are provided around the corresponding inner passage openings 89 in such a manner that the cut-out portions 96 surround respectively the corresponding inner passage openings 89 and are provided in such a manner as to project radially outwards.

As shown in FIG. 2A, the agitator 93 is provided in the inside housing 81. The agitator 93 includes an agitator shank 94 and an agitating vane 95 which extends radially outwards from the agitator shank 94. The agitator shank 94 is supported rotatably on both the inner side walls 84 and rotates by virtue of a rotational force from a motor (not shown) when forming an image.

(2-2) Outside Housing

Figure 9B:
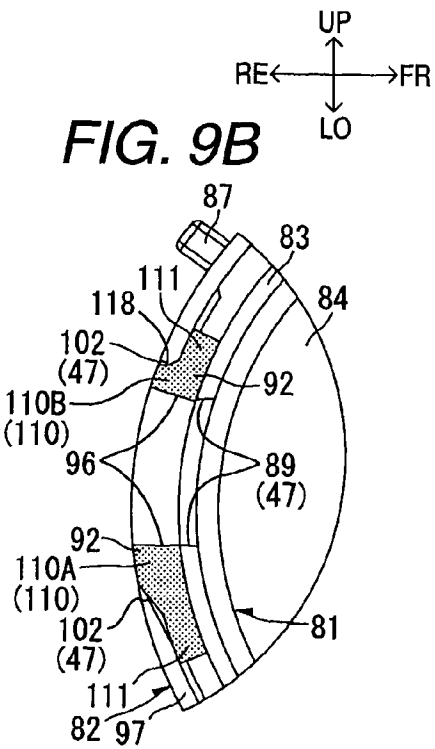
FIG. 9B is an enlarged side sectional view, at a cartridge side passage opening, of the developer cartridge shown in FIG. 9A.
Figure 9A:
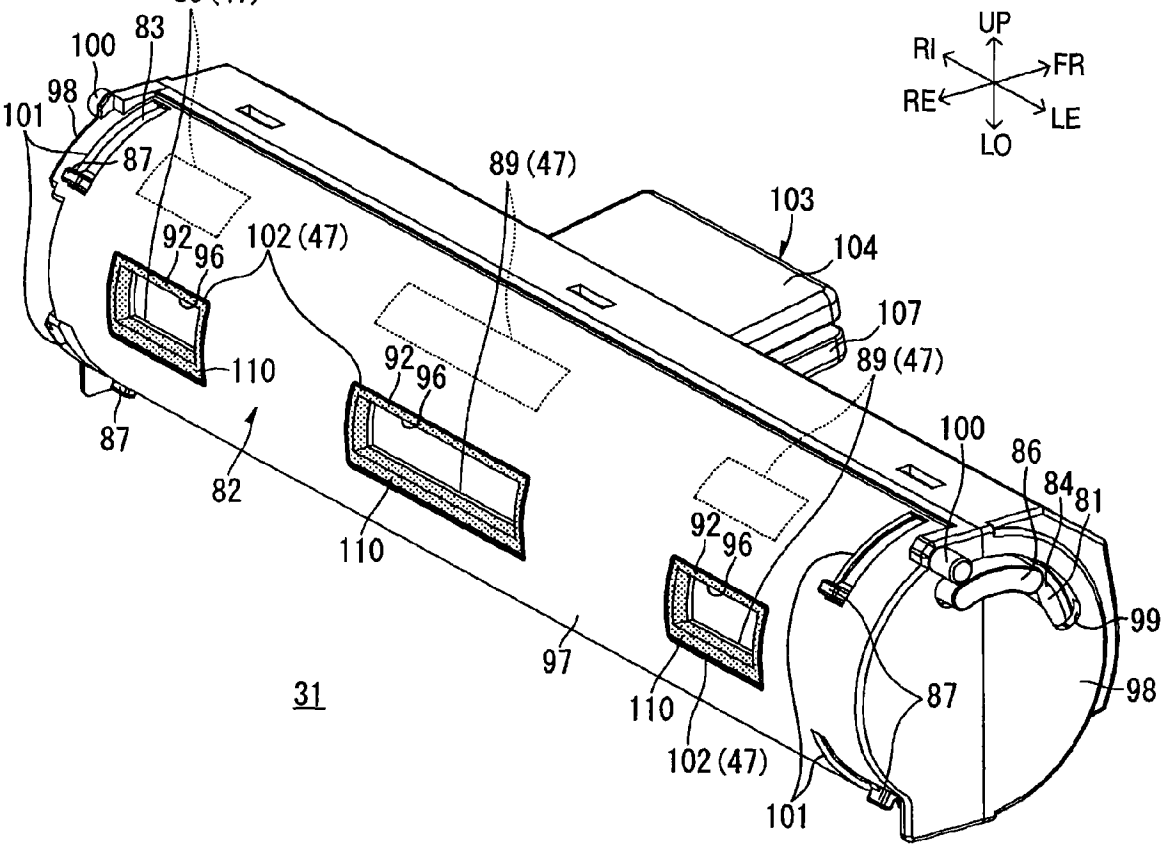
FIG. 9A is a perspective view of the developer cartridge as viewed obliquely from the left rear side, showing a state in which the inside housing is at an opening position.

The outside housing 82 is formed slightly larger in the width direction and the radial direction than the inside housing 81 so as to accommodate the inside housing 81 rotatably therein. As shown in FIG. 9A, the outside housing 82 includes integrally a substantially cylindrical outer circumferential wall 97 and a pair of substantially disk-shaped outer side walls 98 which close both end portions in the width direction of the outer circumferential wall 97. Hereinafter, unless mentioned particularly otherwise, the description will be made based on a state as a reference in which outer passage openings 102 as an example of communication holes which will be described later are oriented to the rear.

Note that part, that is, an upper portion and a front upper portion of an outer circumferential surface of the outer circumferential wall 97 are formed flat, but an inner circumferential surface of the outer circumferential wall 97 has a circular cross section (refer to FIGS. 2A and 2B).

A slide hole into which the sliding projection 86 is inserted is formed in an upper portion of the outer side wall 98. The slide hole 99 is provided in such a manner as to confront the sliding projection 86 in the width direction. The slide hole 99 has an arc shape which is longer than the sliding projection 86 as viewed from the side thereof. A boss 100 is provided at an upper end portion of the outer side wall 98 in such a manner as to project outwards in the width direction. Four elongated holes 101 are formed in both end portions in the width direction of the outer circumferential wall 97 in such a manner that the pairs of holding projections 87 (i.e., the four holding projections 87) are inserted thereinto, respectively. Each elongated hole 101 is provided in such a manner as to confront the corresponding holding projection 87 in the radial direction. The elongated hole 101 has a substantially rectangular shape which extends in the vertical direction as viewed from a back thereof and has a length which corresponds to a swing range of the shutter 68 between the opening position and the closing position.

outer passage openings 102, which are a part of the cartridge side passage openings 47, are formed between the four elongated holes 101 (i.e., between the two upper elongated holes 101 and the two lower elongated holes 101) in the outer circumferential wall 97.

Specifically, three outer passage openings 102 are formed at predetermined intervals in the width direction in such a manner as to correspond respectively to the three inner passage openings 89 and the three frame side passage openings 34 (refer to FIG. 6). Each outer passage opening 102 has a substantially rectangular shape as viewed from a back thereof which is larger than the corresponding inner passage opening 89. When forming an image, the outer passage openings 102 are made to confront respectively to the inner passage openings 89, the cut-out portions 96 of the developer seals 92, the frame side passage openings 34 (refer to FIG. 6), the cut-out portions 59 of the frame seal 58 (refer to FIG. 6) and the shutter openings 69 in the shutter 68 (refer to FIG. 6) which are situated in the positions which correspond thereto in the width direction.

A grip portion 103 is provided on a front side of the outer circumferential wall 97. As shown in FIG. 2A, the grip portion 103 includes an upper grip plate 104 which project forwards from an upper end portion of the outer circumferential wall 97 and a locking arm 105 having a substantially J-shape as viewed from the side thereof which extends downwards below the upper grip plate 104. An upper end portion of the locking arm 105 is supported on a support shaft (not shown) provided below the upper grip plate 104 in such a manner as to swing freely. A locking claw 106 which is locked at a lower fixing portion 67 is provided at a lower end portion of the locking arm 105. A lower grip plate 107 projecting forwards is provided integrally on the locking arm 105 in a position lying in the vicinity of the upper end portion thereof. The lower grip plate 107 is provided in such a manner as to extend substantially parallel to the upper grip plate 104 with a predetermined interval provided therebetween, and a compression spring 109 is interposed between the upper grip plate 104 and the lower grip plate 107 in such a manner as to press both the plates in a direction in which the plates are spaced apart from each other.

(2-3) Relative Arrangement of Inside Housing and Outside Housing

The inside housing 81 is accommodated rotatably in the outside housing 82 and is provided in such a manner as to confront the outside housing 82 (i.e., an inner circumferential surface of the outside housing 82) in an interior of the outside housing 82.

Specifically, an outer circumferential surface of the inner circumferential wall 83 is fitted in the inner circumferential surface of the outer circumferential wall 97 in such a manner as to slide freely in the circumferential direction. To describe this in detail, the developer seals 92 which are provided on the outer circumferential surface of the inner circumferential wall 83 are in contact with the inner circumferential surface of the outer circumferential wall 97, and the developer seals 92 mainly slide relative to the inner circumferential surface of the outer circumferential wall 97. In addition, as shown in FIG. 9A, the sliding projections 86 are inserted into the corresponding slide holes 99. The holding projections 87 are inserted into the corresponding elongated holes 101, and the holding projections 87 project radially outwards from the elongated holes 101.

The inside housing 81 is allowed to move (i.e., rotate) relative to the outside housing 82 between a closing position (refer to FIGS. 5 and 11) where the inner passage openings 89 and the cut-out portions 96 of the developer seals 92 do not confront the outer passage openings 102 and an opening position (refer to FIGS. 2A, 2B, 9A and 9B) where the inner passage openings 89 and the cut-out portions 96 of the developer seals 92 confront the outer passage openings 102.

Figure 11A:
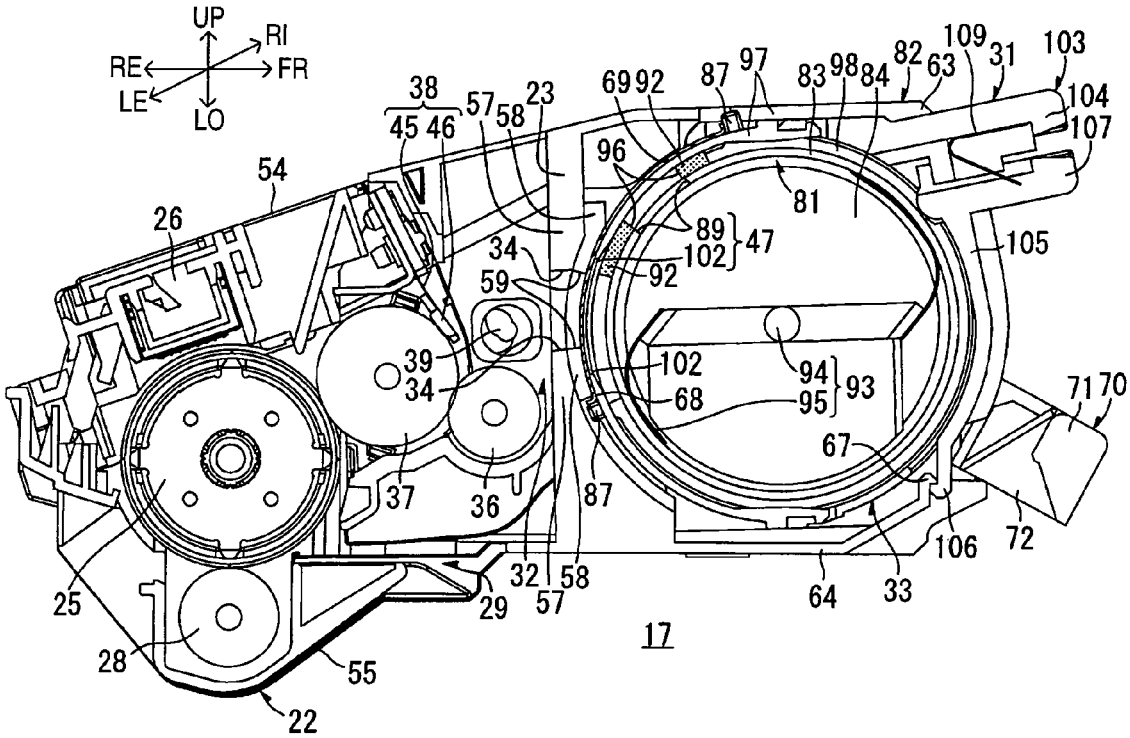
FIG. 11A shows a state in which the swing arm is in the pressing releasing position in FIG. 2A.
Figure 11B:
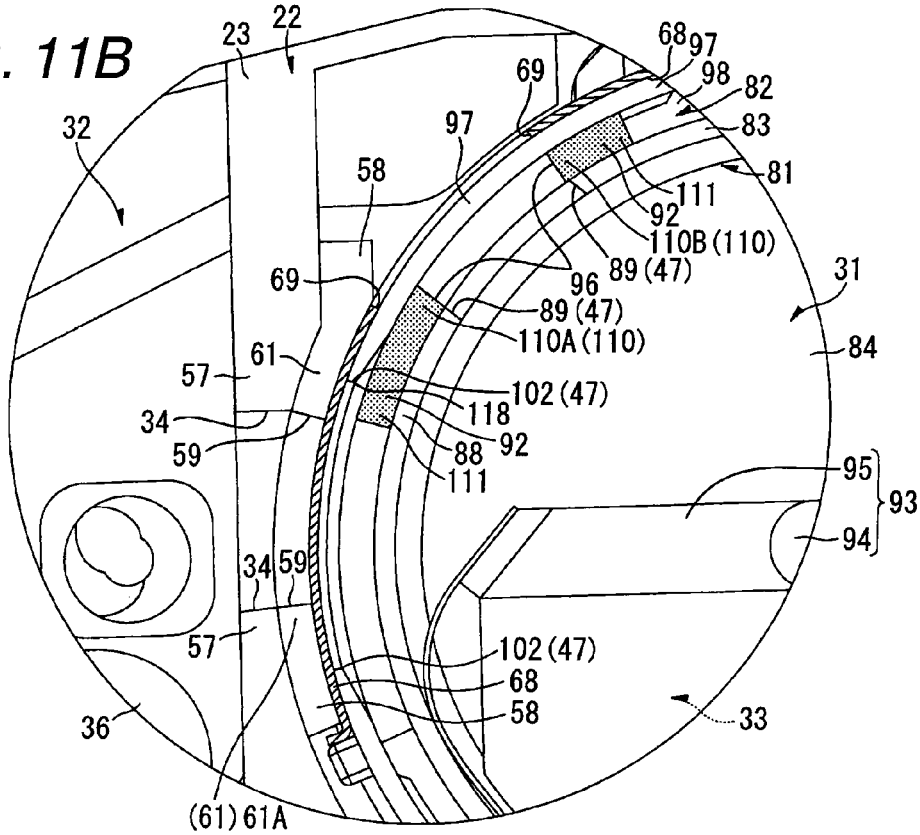
FIG. 11B is a partial enlarged view of FIG. 11A.

As shown in FIG. 5, when the inside housing 81 stays in the opening position, the sliding projections 86 are provided at front end portions of the corresponding slide holes 909, and the holding projections 87 are provided at upper end portions of the corresponding elongated holes 101. In addition, as indicated by broken lines in FIG. 9A and as also shown in FIGS. 11A and 11B, the inner passage openings 89 are provided further upwards than the outer passage openings 102, and the outer passage openings 102 are closed from a radially inside thereof by portions of the inner circumferential wall 83 which lie further downwards than the inner passage openings 89 (i.e., portions indicated by the broken lines in FIG. 9A). To describe this in a reverse fashion, the inner passage openings 89 are closed from an outside thereof by portions of the outer circumferential wall 97 which lie further upwards than the outer passage openings 102. Here, as shown in FIGS. 11A and 11B, the developer seals 92 are compressed between the inner circumferential wall 83 and the outer circumferential wall 97.

In addition, when the inside housing 81 is caused to rotate relative to the outside housing 82 in a direction in which the inner passage openings 89 move towards the outer passage openings 102, and the inner passage openings 89 and the cut-out portions 96 come to confront the outer passage openings 102, the inside housing 81 is provided in the opening position.

When the inside housing 81 is provided in the opening position, as shown in FIG. 9A, the sliding projections 86 are provided at rear end portions of the corresponding slide holes 99, and the holding projections 87 are provided at lower end portions of the corresponding elongated holes 101. In addition, the inner passage openings 89 and the cut-out portions 96 are made to confront the corresponding outer passage openings 102 for communication therewith. Therefore, all the inner passage openings 89, the cut-out portions 96 and the outer passage openings 102 are made to open to each other.

In addition, in such a state that the inside housing 81 is provided in the opening position, inner circumferential edge portions 110 which define the corresponding cut-out portions 96 at the respective developer seals 92 are exposed from the corresponding outer passage openings 102. To describe this in detail, as shown in FIG. 9B, the inner circumferential edge portion 110 projects radially outwards in such a manner that its radially outer surface becomes substantially level with the outer surface of the outer circumferential wall 97. In addition, a portion of each developer seal 92 other than the inner circumferential edge portion 110 (i.e., a portion which lies farther from the cut-out portion 96 than the inner circumferential edger portion 110 and is referred to as an outer circumferential edge portion 111) is compressed between the outer circumferential wall 97 and the inner circumferential wall 83 in such a manner as to surround the corresponding inner passage opening 89. By this configuration, developer is prevented from leaking from the inner passage openings 89 and the outer passage openings 102 which are in a communicating state into a gap defined between the outer circumferential wall 97 and the inner circumferential wall 83.

As described above, the inside housing 81 moves upwards from the opening position to the closing position relative to the outside housing 82, while the inside housing 81 moves downwards from the closing position to the opening position relative to the outside housing 82 (refer to FIGS. 2A, 2B, 9A, 9B, 11A and 11B). In addition, in this developer cartridge 31, the inner passage openings 89 are opened and closed by the outside housing 82 by the relative movement between the inside housing 81 and the outside housing 82.

(3) Mount and Removal of Developer Cartridge to and from Process Frame (3-1) Mount of Developer Cartridge to Process Frame When mounting the developer cartridge 31 to the process frame 22, as shown in FIG. 5, the upper grip plate 104 and the lower grip plate 107 are held together in a direction in which the grip plates approach each other against a pressing force of the compression spring 109 (refer to FIG. 2A). Then, the developer cartridge 31 (i.e., the developer cartridge 31 in which the inside housing 81 is provided in the closing position) is mounted to the cartridge holding part 33 (i.e., the developer cartridge holding part 33 in which the shutter 68 is provided in the closing position, and the swing arm 70 is provided in the pressing releasing position).

By the series of actions, the developer cartridge 31 is placed on the bottom plate 64. As this occurs, the bosses 100 are received by the corresponding fixing portions 66, the sliding projections 86 are fitted in the corresponding receiving recessed portions 75, and as shown in FIG. 2A, the pairs of holding projections 87 which are provided on both the ends in the width direction of the developer cartridge 31 are made to hold upper ends and lower ends of both the end portions in the width direction of the shutter 68. By this action, the inside housing 81 having the sliding projections 86 and the holding projections 87 are brought into engagement with the swing arm 70 and the shutter 68, respectively.

Thereafter, the holding of the upper grip plate 104 and the lower grip plate 107 is released, the locking arm 105 swings by virtue of the pressing force of the compression spring 109, the locking claw 106 is locked at the lower fixing portion 67, and the developer cartridge 31 is accommodated in the cartridge holding part 33, so as to be held by the cartridge holding part 33.

By the bosses 100 being received by the upper fixing portions 66 and the locking claw 106 being locked at the lower fixing portion 67, the outside housing 82 is fixed by the cartridge holding part 33. As this occurs, as shown in FIGS. 11A and 11B, the frame side passage openings 34 and the corresponding cartridge side passage openings 47 (specifically, the outer passage openings 102) confront each other in the longitudinal direction across the shutter 68 which stays in the closing position.

Then, the swing arm 70 is swung from the pressing releasing position to the pressing position. By this action, the sliding projections 86 which are fitted in the corresponding receiving recessed portions 75 (refer to FIG. 5) slide rearwards in the corresponding slide holes 99 so as to be provided at the rear end portions of the sliding holes 99 as the swing arm 70 swings (refer to FIG. 9A). In accordance with this, the pairs of holding projections 87 provided at both the ends in the width direction slide downwards in the corresponding elongated holes 101 while holding the shutter 68 therebetween, so as to be provided at the lower end portions of the elongated holes 101 (refer to FIG. 9A).

By this action, the inside housing 81 is provided in the opening position. Thus, as shown in FIGS. 2A and 9, the inner passage openings 89 and the cut-out portions 96 of the developer seals 92 are made to confront the corresponding outer passage openings 102 in the substantially horizontal direction. Therefore, the inner passage openings 89 and the cut-out portions 96 are allowed to communicate with the outer passage openings 102. In addition, the shutter 68, which is in engagement with the inside housing 81, moves together with the inside housing 81 so as to be provided in the opening position, and the frame side passage openings 34 and the cut-out portions 59 of the frame seal 58 are made to confront the corresponding shutter openings 69 and cartridge side passage openings 47 (i.e., including the inner passage openings 89, the cut-out portions 96 and the outer passage openings 102 which are in the communicating state therewith) in the substantially horizontal direction. Accordingly, the frame side passage openings 34 and the cut-out portions 59 are allowed to communicate with the shutter openings 69 and the cartridge side passage openings 47.

As shown in FIG. 2B, when both the inside housing 81 and the shutter 68 are in the opening positions, the inner circumferential edge portions 110 of the respective developer seals 92 which project radially to the outside of the outer circumferential wall 97 project rearwards in such a manner as to surround the corresponding shutter openings 69 without any gap provided therebetween. To describe this in detail, a lower circumferential edge portion 110A of the inner circumferential edge portion 110 which lies further downwards than the cut-out portion 96 is brought into press contact with a lower circumferential edge portion 61A of an inner circumferential edge portion 61 in the frame seal 58 which defines the cut-out portion 59 which lies further downwards the cut-out portion 59. In addition, an upper circumferential edge portion 110B of the inner circumferential edge portion 110 in the developer seal 92 which lies further upwards than the cut-out portion 96 is brought into press contact with the shutter 68 (i.e., a portion of the shutter 68 which lies further upwards than the shutter opening 69).

In this way, since gaps defined between the inner passage openings 89 and the frame side passage openings 34 are surrounded with no gap defined therebetween by the frame seal 58, the developer seals 92 and the shutter 68, the leakage of the developer between the inner passage openings 89 and the frame side passage openings 34 is prevented.

In addition, when an image is formed, developer accommodated in the interior of the inside housing 81 passes through the inner passage openings 89, the cut-out portions 96 of the developer seals 92, the outer passage openings 102, the shutter openings 69, the cut-out portions 59 of the frame seal 58 and the frame side passage openings 34 along the substantially horizontal direction as indicated by a thick arrow shown in FIG. 2B by agitation by the agitator 93, so as to be supplied to the interior of the developing part 32. Namely, the inner passage openings 89 are opened, and the passage of the developer at the inner passage openings 89 is permitted.

Incidentally, the developer may be circulated between the developing part 32 and the developer cartridge 31. As this occurs, the developer accommodated in the developer cartridge 31 is supplied into the interior of the developing part 32 via the cartridge side passage opening 47 (refer to FIG. 9A) and the frame side passage opening 34 (refer to FIG. 6) which are situated in the center in the width direction. The supplied developer is then supplied to the supply roller 36 while being conveyed towards both ends in the width direction of the developing part 32 by the auger 39. While the developer is being so supplied, part of the developer is returned to the interior of the developer cartridge 31 via the frame side passage openings 34 and the cartridge side passage openings 47 which are situated at both the ends in the width direction of the cartridge holding part 33 and the developer cartridge 47, respectively.

(3-2) Removal of Developer Cartridge from Process Frame

To remove the developer cartridge 31 from the process frame 22, firstly, the swing arm 70 is swung from the pressing position (refer to FIG. 2A) to the pressing releasing position (refer to FIG. 3A).

Referring to FIG. 5, when the swing arm 70 is swung from the pressing position to the pressing releasing position, the sliding projections 86 which are fitted in the receiving recessed portions 75 start sliding to the front in the corresponding slide holes 99 as the side arm plates 72 swing. In response hereto, the inside housing 81 starts moving from the opening position to the closing position, and the pairs of holding projections at both the ends in the width direction of the inside housing 81 shown in FIGS. 2A and 2B start sliding upwards in the corresponding elongated holes 101 while holding the shutter 68 therebetween.

Figure 10A:
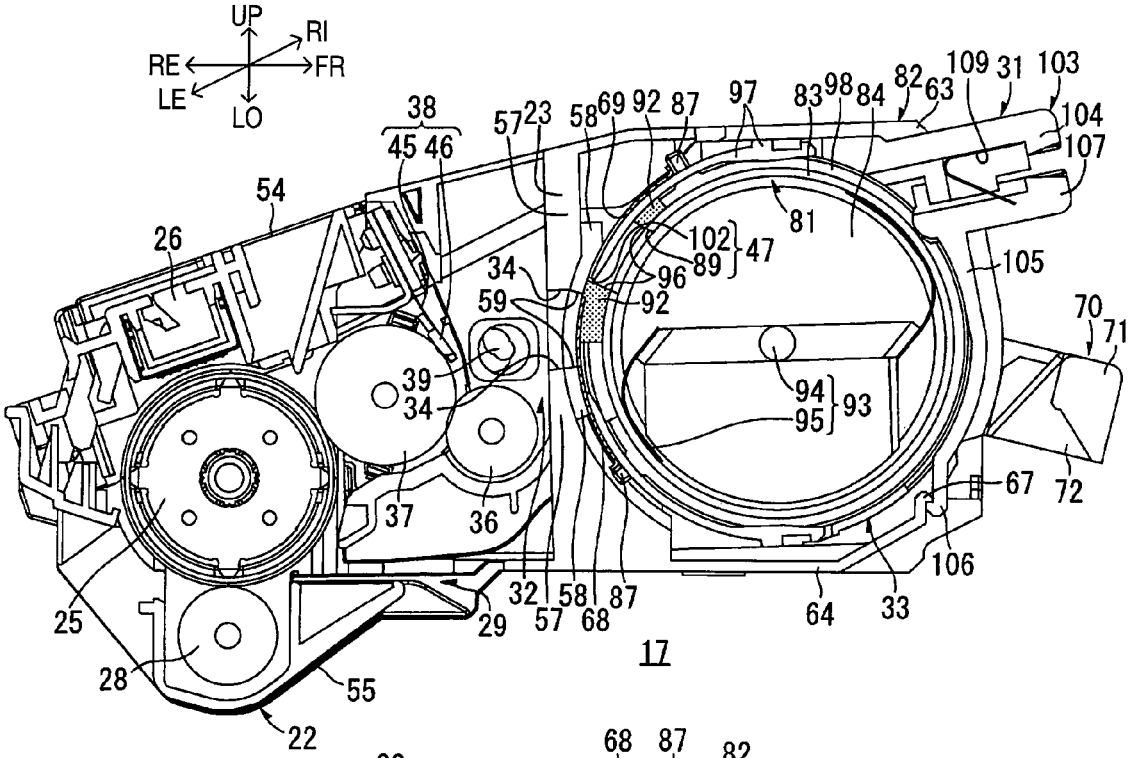
FIG. 10A shows a state in which the swing arm is positioned between the pressing position and the pressing releasing position in FIG. 2A.
Figure 10B:
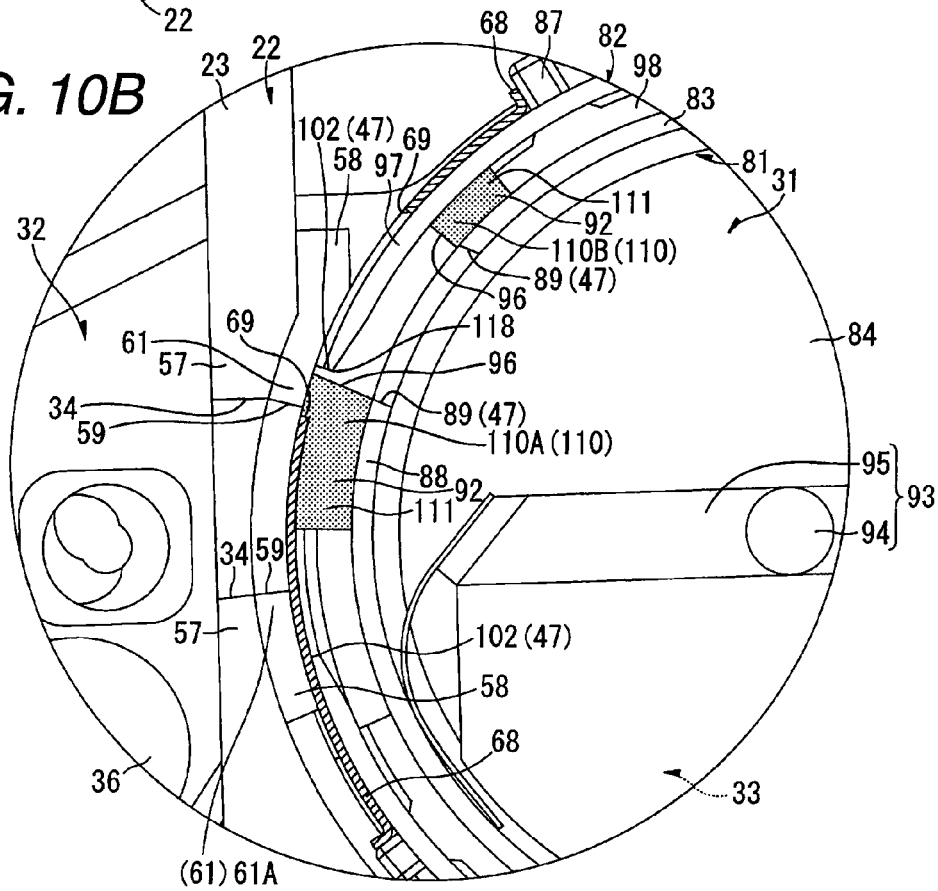
FIG. 10B is a partial enlarged view of FIG. 10A.

When the inside housing 81 moves further towards the closing position, the upper circumferential edge portions 110B and the lower circumferential edge portions 110A of the developer seals 92 are sequentially brought into contact with portions on the outer circumferential wall 97 which comprise upper circumferential edges of the outer passage openings 102 (referred to as upper contact portions 118) and then enter between the outer circumferential wall 97 and the inner circumferential wall 83 while the upper circumferential edge portions 110B and the lower circumferential edge portions 110A are being compressed towards the inner circumferential wall 83 side (refer to FIGS. 2B, 10B and 11B).

In addition, referring to FIG. 5, when the inside housing 81 moves towards the closing position, the sliding projections 86 are provided at the front end portions of the corresponding slide holes 99, and the pairs of holding projections 87 at both the ends in the width direction of the inside housing 81 slide upwards in the corresponding elongated holes 101 while holding the shutter 68 therebetween so as to be provided at the upper end portions of the elongated holes 101.

Thus, as shown in FIGS. 11A and 11B, the inside housing 81 is provided in the closing direction, and the outer passage openings 102 and the inner passage openings 89 are closed. By closing the inner passage openings 89, the passage of the developer at the inner passage openings 89 is restricted. In addition, the shutter 68 which is in engagement with the inside housing 81 moves together with the inside housing 81 so as to be provided in the closing position, the frame side passage openings 34 and the cut-out portions 59 in the frame seal 58 are made to confront the shutter 68 to thereby be closed (refer to FIGS. 3A and 3B).

Then, when the upper grip plate 104 and the lower grip plate 107 are held in the direction in which they approach each other, the locking of the locking claw 106 to the lower fixing portion 67 is released. Thus, as shown in FIG. 5, in the event that the developer cartridge 31 is pulled forwards from the cartridge holding part 33 in that state, the sliding projections 86 are disengaged from the corresponding receiving recessed portions 75, and the holding projections 87 are disengaged from the shutter 68. By the series of actions, the engagement of the inside housing 81 with the swing arm 70 and the shutter 68 is released individually, and the developer cartridge 31 is removed from the process frame 22.

(Developer Seal)

Referring to FIGS. 12A to 16B, examples of the developer seal 92 will be described.

(1) REFERENCE EXAMPLE

Figure 12A:
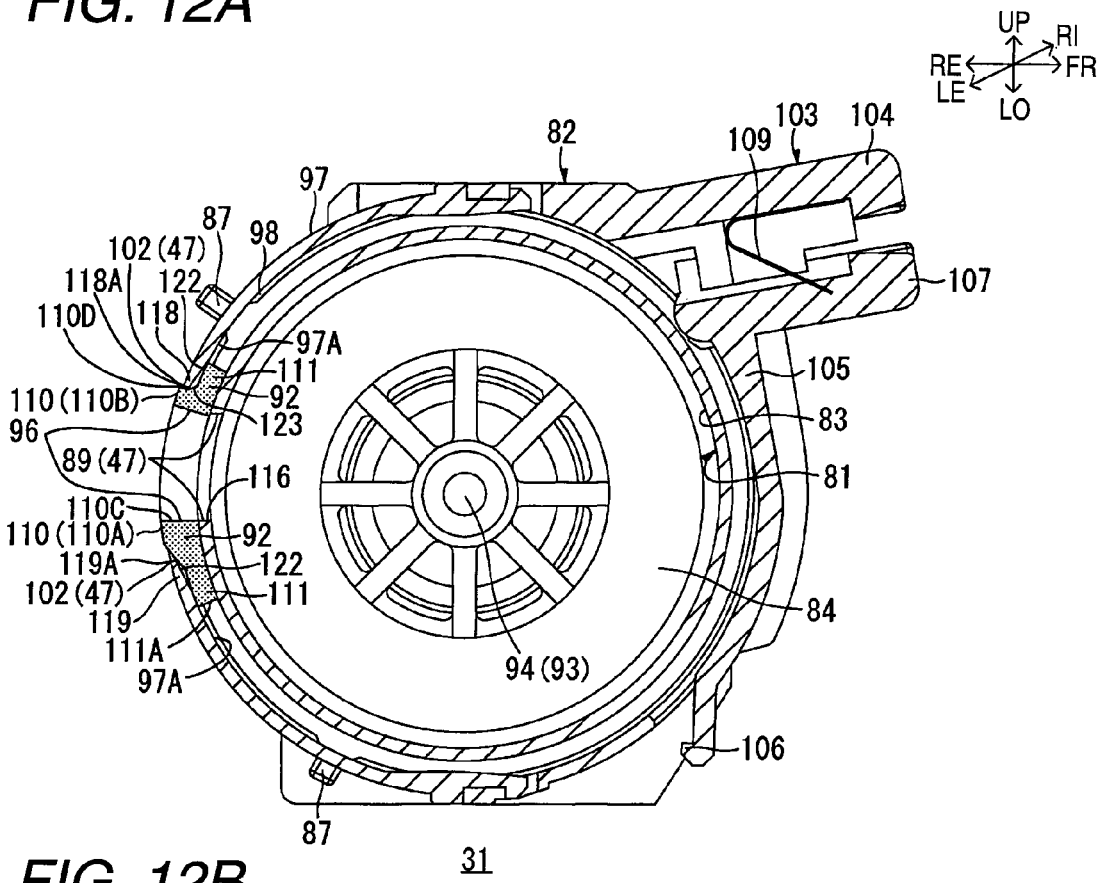
Figure 12B:
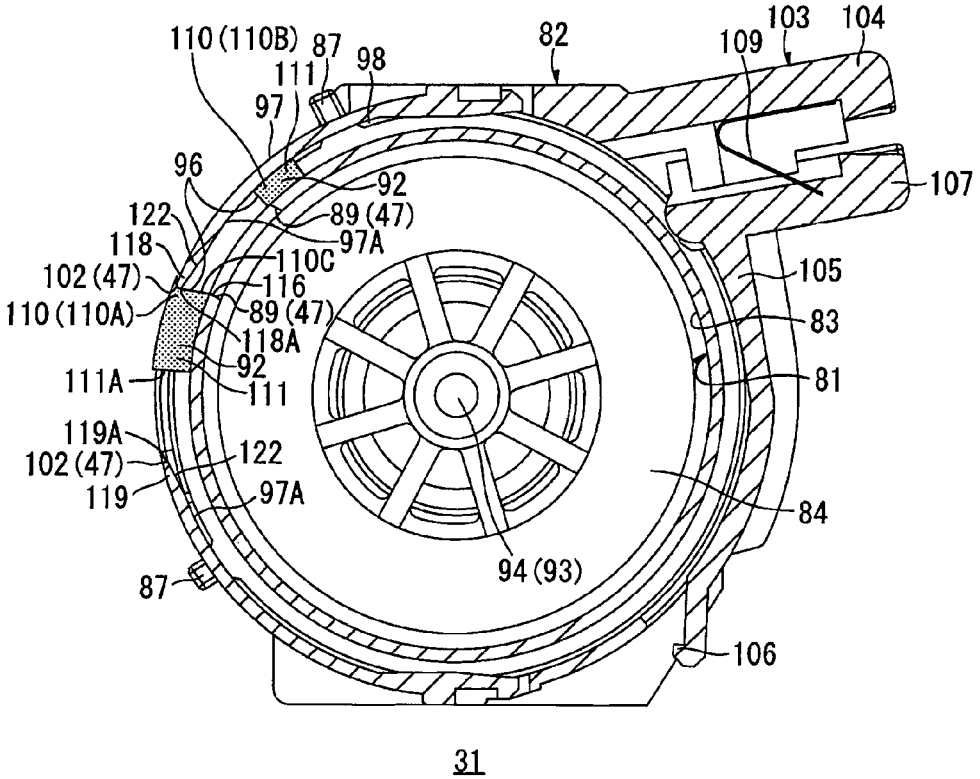

FIGS. 12A and 12B are cross sectional views of the developer cartridge according to a reference example.

As shown in FIG. 12A, in the developer cartridge 31 according to the reference example, when an inside housing 81 is provided in an opening position, inner circumferential edge portions of respective developer seals 92 project radially outwards in such a manner that a radial outer surface thereof becomes substantially level with an outer surface of an outer circumferential wall 97. In each developer seal 92, an outer circumferential edge portion 111 which comprise a portion other than the inner circumferential edge portion 110 is compressed between the outer circumferential wall 97 and an inner circumferential wall 83 so as to surround a corresponding inner passage opening 89.

Then, when the inside housing 81 is caused to move relative to an outside housing 82 from an opening position towards a closing position, as has been described above, the upper circumferential edge portions 110B and the lower circumferential edge portions 110A of the developer seals 92 are sequentially brought into contact with upper contact portions 118 which comprise upper circumferential edges of outer passage openings 102 on the outer circumferential wall 97 of the outside housing 82 and then enter a gap defined between the outer circumferential wall 97 and the inner circumferential wall 83 while the upper circumferential edge portions 110B and the lower circumferential edge portions 110A are being compressed to the inner circumferential wall 83 side (refer to FIGS. 2B, 10B and 11B).

FIG. 12B shows a state in which the lower edge portion 110A of the developer seal 92 is brought into contact with the upper contact portion 118 of the outside housing 82 from an upper side thereof in a halfway position when the inside housing 81 is caused to move from the opening position to the closing position relative to the outside housing 82. As this occurs, at the lower circumferential edge portion 110A, an upper end face 110C thereof is made to confront the upper contact portion 118 for contact therewith. In other words, when the inside housing 81 is caused to move from the opening position to the closing position relative to the outside housing 82, the upper contact portion 118 of the outside housing 82 is brought into abutment with the upper end face 110C of the lower circumferential edge portion 110A of the developer seal 92 in such a manner as to bite into the upper end face 110C from thereabove.

Thus, when the inside housing 81 moves relative to the outside housing 82, seal side confronting portion (here, the upper end face 110C of the lower circumferential edge portion 11A) which confronts the outside housing 82 exists on each of the developer seals 92 provided on the inside housing 81. Therefore, when the inside housing 81 moves relative to the outside housing 82, the upper end face 110C may be brought into hard contact with the outside housing 82 (i.e., the upper contact portion 118), and the developer seal 92 may be damaged at the upper end face 110C.

In the developer seal 92, as with the upper end face 110C of the lower circumferential edge portion 110A, an upper end face 110D (refer to FIG. 12A) of the upper circumferential edge portion 110B is made to confront the upper contact portion 118 for contact therewith when the inside housing 81 is caused to move from the opening position to the closing position relative to the outside housing 82. Thus, the developer seal 92 may also be damaged by being brought into hard contact with the upper contact portion 118 at the upper end face 110D of the upper circumferential edge portion 110B.

Further, when the inside housing 81 is caused to rotate from the closing position towards the opening position relative to the outside housing 82, a lower end face 111A of an outer circumferential edge portion 111 of the developer seal 92 is made to confront a lower contact portion 119 which comprises a lower circumferential edge of the outer passage opening 102 in the outside housing 82 from thereabove for contact therewith. Thus, the developer seal 92 may also be damaged by being brought into hard contact with the lower contact portion 119 at the lower end face 111A of the outer circumferential edge portion 111. Here, the upper contact portion 118 and the lower contact portion 119 function as an example of a first frame side confronting portion. In addition, the upper end face 110C of the lower circumferential edge portion 110A, the upper end face 110D of the upper circumferential edge portion 110B and the lower end face 111A of the outer circumferential edge portion 111 of the developer seal 92 function as an example of a seal side confronting portion.

(2) FIRST EXAMPLE

Figure 13A:
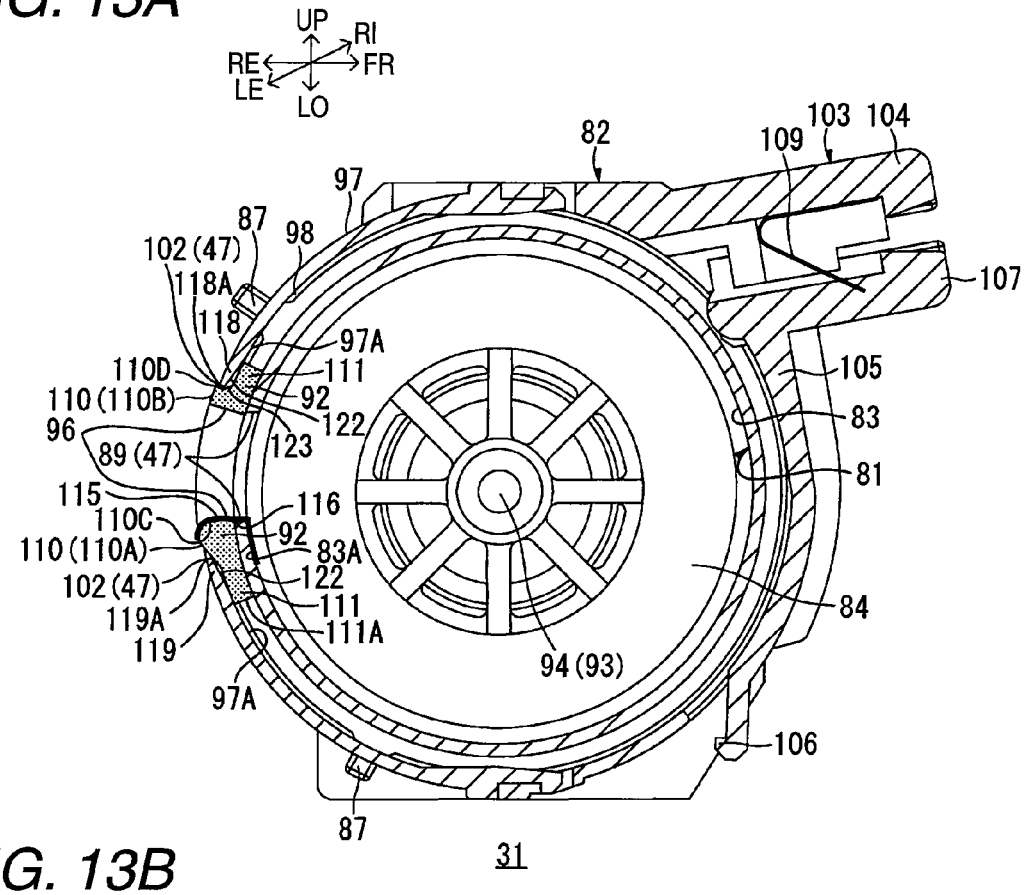
FIGS. 13A and 13B show the developer cartridge, in which a first example is applied to FIGS. 12A and 12B.
Figure 13B:
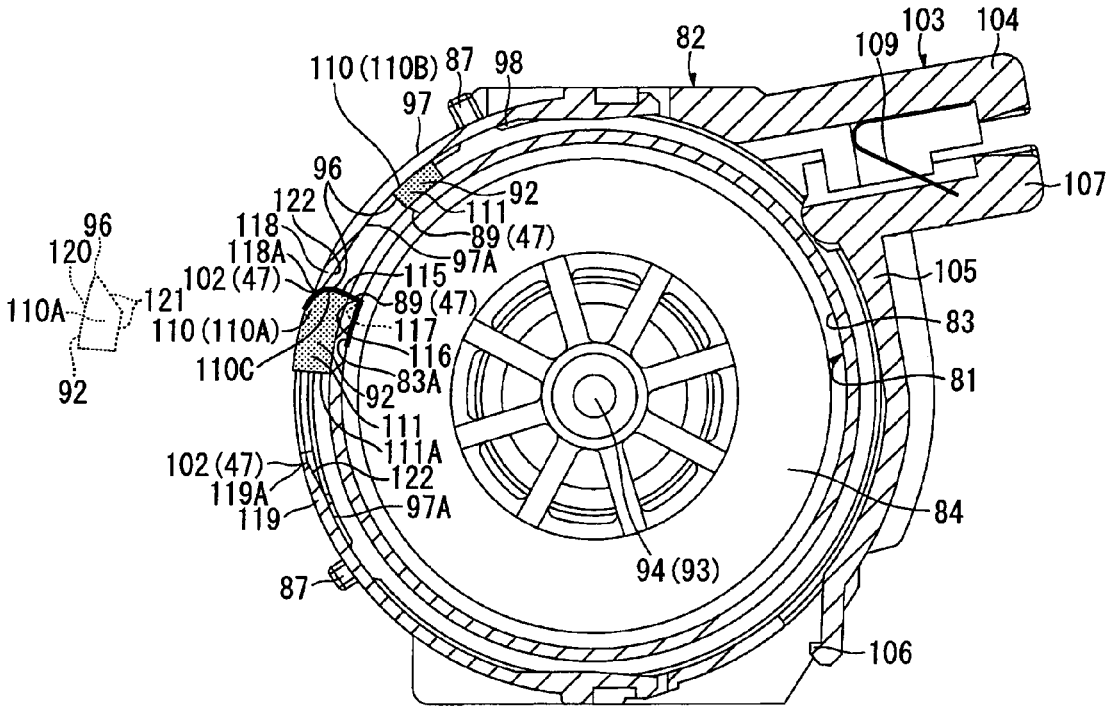

FIGS. 13A and 13B are cross sectional views of the developer cartridge according to a first example.

As shown in FIGS. 13A and 13B, protection members 115 are provided on the inside housing 81. The protection members 115 are made of a material having a higher elastic modulus (that is, robuster and more difficult to be deformed) than the developer seals 92 and take the form of a tape.

Specifically, the protection member 115 in the first example is stuck to be integrated with at least any of the upper end face 110C of the lower circumferential edge portion 110A, the upper end face 110D (refer to FIG. 13A) of the upper circumferential edge portion 110B and the lower end face 111A of the outer circumferential edge portion 111 of each of the developer seals 92 (that is, the portions of the developer seal 92 which confront to contact the outside housing 82). Incidentally, the description will be made based on a reference in a case in which the each of the protection members 115 is stuck to only the upper end face 110C of the lower circumferential edge portion 110A among these upper end face 110C, upper end face 110D and lower end face 111A.

When the inside housing 81 is caused to move from the opening position to the closing position relative to the outside housing 82, each of the protection members 115 stuck to the upper end face 110C of the lower circumferential edge portion 110A is provided between the upper end face 110C and the upper contact portion 118 of the outside housing 82, as shown in FIG. 13B. Therefore, even though the upper end face 110C of the lower circumferential edge portion 110A approaches the upper contact portion 118 during the relative movement of the inside housing 81, each of the protection members 115 is brought into contact with the upper contact portion 118 in place of the upper end face 110C. Accordingly, it is possible to avoid that the upper end face 110C of the lower circumferential edge portion 110A is brought into contact with the upper contact portion 118 to be subjected to an external force applied from the upper contact portion 118.

Namely, when the inside housing 81 moves relative to the outside housing 82, the protection members 115 are provided between the upper end face 110C and the outside housing 82 (i.e., the upper contact portion 118). Therefore, the contact of the upper end face 110C with the outside housing 82 can be prevented, and thus the developer seal 92 can be protected.

As a result, the developer seal 92 can be prevented from being damaged at the upper end face 110C when the inside housing 81 moves relative to the outside housing 82.

In addition, since the contact of the upper end face 110 with the upper contact portion 118 can be avoided as described above, the deformation of the developer seal 92 at the upper end face 110C is suppressed. Therefore, it makes possible to prevent developer on the upper end face 110C from being scattered by an impact that would otherwise be caused when the developer seal 92 is deformed.

Further, since the protection members 115 are provided integrally on the upper end face 110C, it is possible to ensure that the protection members 115 are provided between the upper end face 110C and the outside housing 82 (i.e., the upper contact portion 118) when the inside housing 81 moves relative to the outside housing 82. Therefore, the contact of the upper end face 110C with the outside housing 82 can be prevented in an ensured fashion. Namely, the protection members 115 can protect the developer seal 92 in the ensured fashion.

Incidentally, when the protection members 115 are provided on both the upper end face 110D of the upper circumferential edge portion 110B and the lower end face 111A of the outer circumferential edge portion 111 of each of the developer seals 92, both of the protection members 115 provided on both the upper end face 110*d* and the lower end face 111A function in the same manner as the protection members 115 provided on the upper end face 110C of the lower circumferential edge portion. Therefore, the developer seal 92 at the upper end face 110D and the lower end face 111A can be protected.

In addition, the protection members 115 stuck to the upper end face 110C of the lower circumferential edge portion 110A are stuck in such a manner as to extend from the upper end face 110C to the inside housing 81 (specifically, from the lower circumferential edge portion 116 on the inner circumferential wall 83 which comprises the lower circumferential edge of the inner passage opening 89 to a continuous portion 83A on the inner circumferential surface of the inner circumferential wall 83 which continues to the lower circumferential edge portion 16) with a tension applied thereto. Accordingly, the protection members 115 and the lower circumferential edge portion 110A are drawn to the inside housing 81 side so as to be rounded by the tension applied to the protection members 115. Thus, when the inside housing 81 is caused to move towards the closing position relative to the outside housing 82, the developer seals 92 can move smoothly to the inside of the outside housing 82 without being caught on the corresponding protection members 115.

In addition, as with the lower circumferential edge portion 110A of the developer seal 92 which is indicated by broken lines in FIG. 13B, the thickness of the developer seal 92 (i.e., the left side sectional shape) is made to be thinned gradually as it approaches the cut-out portion 96. To describe this in detail, while an outer surface 120 of the lower circumferential edge portion 110A which is not stuck to the inside housing 81 is formed substantially flat, an inner surface 121 which is stuck to the inside housing 81 is inclined in such a manner as to approach the outer surface 120 as it approach the cut-out portion 96. With the developer seal 92 that is configured in this way stuck to the inside housing 81, as with the case where the tension of the each of the protection members 115 is utilized in the way described above, the lower circumferential edge portion 110A is drawn to the inside housing 81 side so as to be rounded (refer to the lower circumferential edge portion 110A indicated by a solid line).

In addition, inclined surfaces 122 are formed on both the upper contact portion 118 and the lower contact portion 119 of the outside housing 82. Specifically, the inclined surface 122 of the upper contact portion 118 is connected to both a lower end face 118A of the upper contact portion 118 and an inner circumferential surface 97A of the outer circumferential wall 97 while intersecting those surfaces. The inclined surface 122 of the lower contact portion 119 is connected to an upper end face 119A of the lower contact portion 119 and the inner circumferential surface 97A of the outer circumferential wall 97 while intersecting those surfaces.

By the inclined surface 122 being provided on the upper contact portion 118 in this way, when the inside housing 81 is caused to move towards the closing position relative to the outside housing 82, at the developer seal 92, the upper end face 110C of the lower circumferential edge portion 110A can be brought into moderate contact with the upper contact portion 118 at the inclined surface 122 of the upper contact portion 118. Thus, even though the upper end face 110C and the upper contact portion 118 are brought into contact with each other without the protection members 115, the developer seal 92 can be prevented from being damaged at the upper end face 110C.

Similarly, when the inside housing 81 is caused to move towards the closing position relative to the outside housing 82, at the developer seal 92, the upper end face 110D (refer to FIG. 13A) of the upper circumferential edge portion 110B can be brought into moderate contact with the upper contact portion 118 at the inclined surface 122 of the upper contact portion 118, thereby making it possible to prevent the developer seal 92 being damaged at the upper end face 110D. In addition, when the inside housing 81 is caused to move towards the opening position relative to the outside housing 82, at the developer seal 92, the lower end face 111A of the outer circumferential edge portion 111 can be brought into moderate contact with the lower contact portion 119 at the inclined surface 122 of the lower contact portion 119, thereby making it possible to prevent the developer seal 92 from being damaged at the lower end face 111A.

Additionally, as has been described above, at the developer seal 92, the upper end face 110C of the lower circumferential edge portion 110A is brought into moderate contact with the upper contact portion 118 at the inclined surface 122 of the upper contact portion 118. Thus, in a case where the outside housing 82 is provided on the outside of the inside housing 81 as in the invention, when the inside housing 81 moves towards the closing position relative to the outside housing 82, the developer seals 92 are allowed to move smoothly into the inside of the outside housing without being caught on the outside housing 82 (i.e., the upper contact portions 118) at the upper end faces 110C.

Similarly, the developer seals 92 are allowed to move smoothly into the inside of the outside housing 82 without being caught on the outside housing 82 (i.e., the upper contact portions 118) at the upper end faces 110D (refer to FIG. 13A) of the upper circumferential edge portions 110B. In addition, when the inside housing moves towards the opening position relative to the outside housing 82, the developer seals 92 are allowed to move smoothly into the inside of the outside housing 82 without being caught on the outside housing 82 (i.e., the lower contact portions 119) at the lower end faces 111A of the outer circumferential edge portions 111 (refer to FIG. 13A).

Figure 14A:
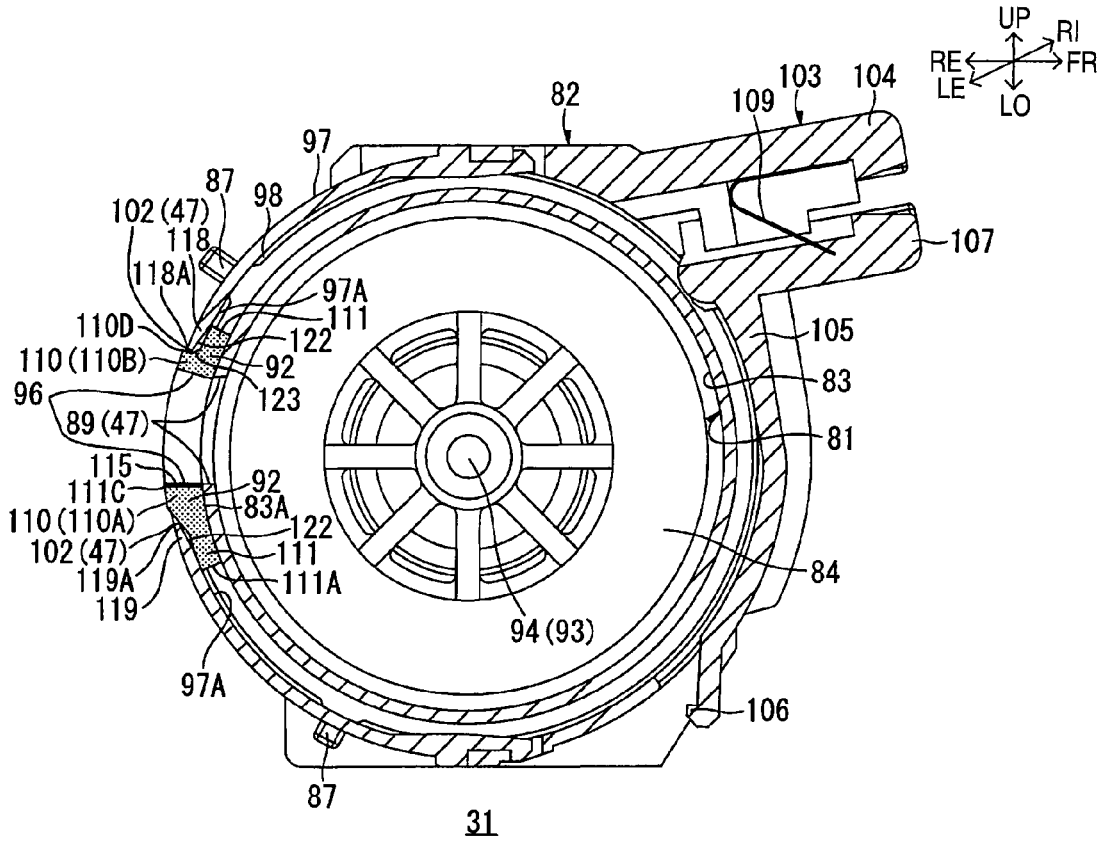
FIGS. 14A and 14B show the developer cartridge, in which a second example is applied to FIGS. 12A and 12B.
Figure 14B:
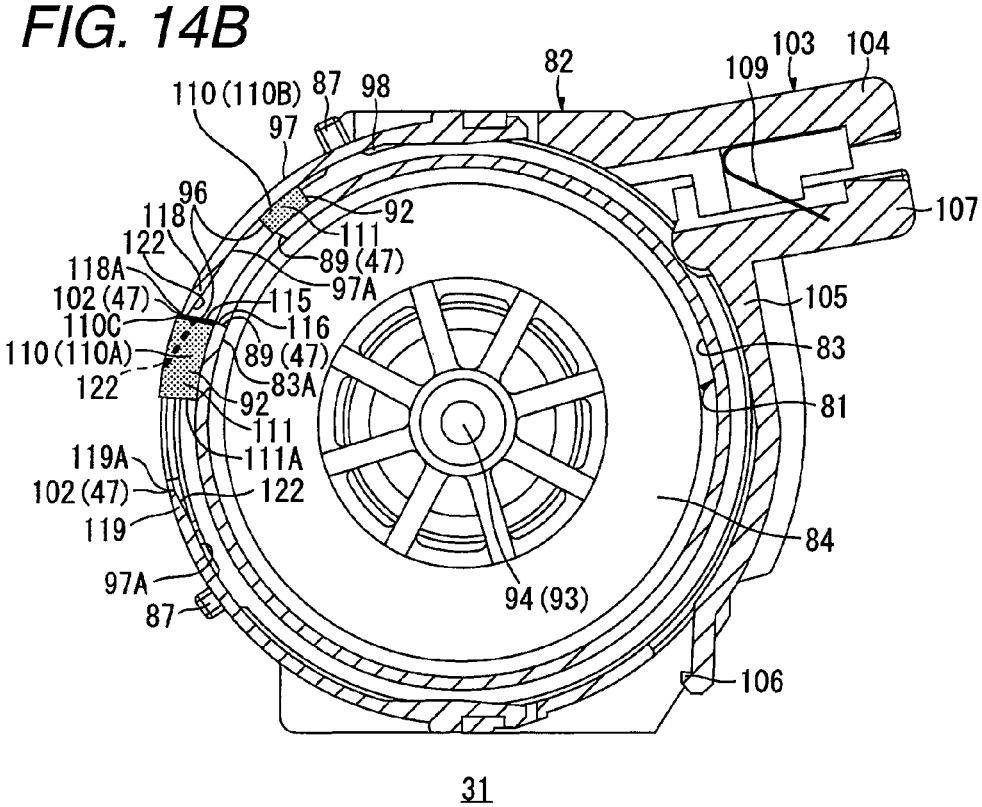

In addition, the inclined surfaces 122 which functions in the way described above maybe formed on the portions (i.e., the upper end face 110C of the lower circumferential edge portion 110A, the upper end face 110D of the upper circumferential edge portion 110B and the lower end face 111A of the outer circumferential edge portion 111) of the developer seal 92 which are made to confront to contact the outside housing 82 (i.e., the upper contact portion 118 and the lower contact portion 119) (for example, refer to an inclined surface 122 indicated by a thick broken line at a lower circumferential edge portion 110A in FIG. 14B). Here, for example, in the event that a rear portion of the lower circumferential edge portion 116 (i.e., a portion which comprises a lower circumferential edge of the inner passage opening 89) of the inner circumferential wall 83 is chamfered (refer to a chamfered portion 117 indicated by a dotted line in FIG. 13B), when the developer seal 92 is stuck, an inclined surface like the inclined surface 122 is formed naturally on the upper end face 110C of the lower circumferential edge portion 110A of the developer seal 92.

(3) SECOND EXAMPLE

FIGS. 14A and 14B are cross sectional views of the developer cartridge according to a second example.

Each of protection members 115 according to the second example shown in FIGS. 14A and 14B is a resin layer which is integrally provided on the upper end face 110C by coating a surface (here, the upper end face 110C of the lower circumferential edge portion 110A) of each of the developer seals 92 with a resin. As with the first example, each of the protection members 115 (i.e., each of the resin layers) according to the second example have a higher elastic modulus than that of the developer seal 92. Each of the resin layers may be made up of, for example, a film layer of adhesive or paint applied to the surface of the developer seal 92. Namely, the protection members 115 can be provided integrally on the upper end face 110C by a simple work in which the surface of the developer seal 92 is coated in the way described above.

In addition, the resin layer may be formed on the surface of the developer seal 92 by melting the surface by applying a heat treatment thereto.

Further, the developer seal 92 may be molded in such a manner that a skin layer having a higher density (i.e., robustness) than that of an interior of the developer seal 92, and the skin layer so formed may be made to comprise the resin layer. Namely, the protection members 115 are the surface portion of the developer seal 92 whose density is increased higher than that of the interior thereof and is provided integrally on the upper end face 110C. Therefore, by utilizing the surface portion as the protection member 115, the necessity of providing a protection member 115 separately can be obviated. Accordingly, it makes possible to reduce the number of components.

Incidentally, the above-described protection members 115 according to the second example may be, as with the first example, provided integrally not only on the upper surface 110C of the lower circumferential edge portion 110A but also on at least either of the upper end face 110D of the upper circumferential edge portion 110B and the lower end face 111A of the outer circumferential edge portion 111 (that is, the portions of the developer seal 92 which confront to contact the outside housing 82).

(4) THIRD EXAMPLE

Figure 15A:
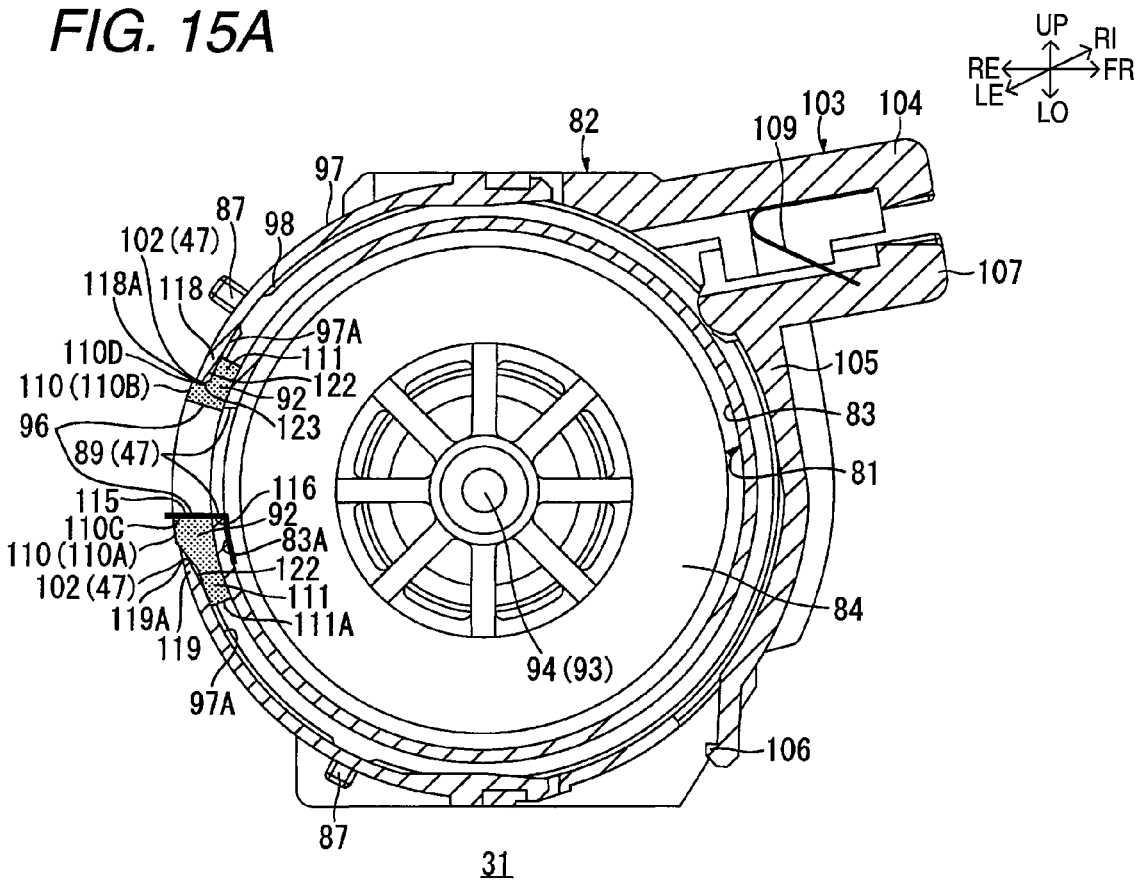
FIGS. 15A and 15B show the developer cartridge, in which a third example is applied to FIGS. 12A and 12B.
Figure 15B:
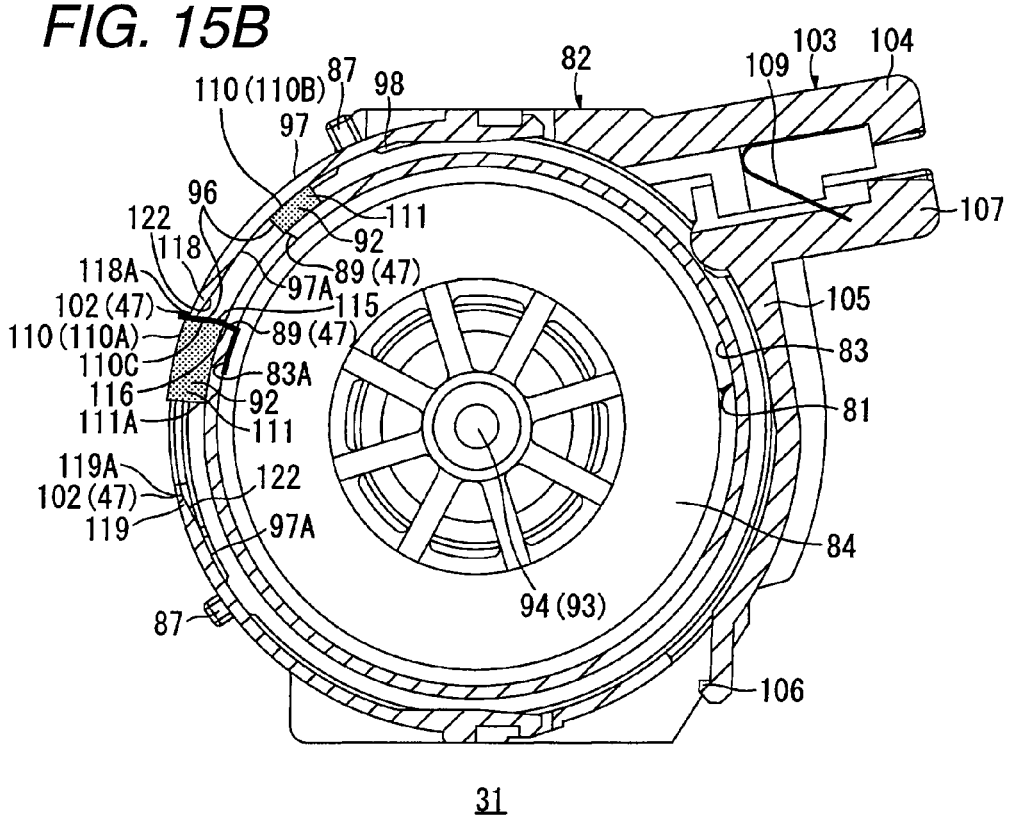

FIGS. 15A and 15B are cross sectional views of the developer cartridge according to a third example.

Each of the protection members 115 according to the third example shown in FIGS. 15A and 15B is formed of, for example, a PET sheet. Specifically, the protection members 115 are supported on an inner portion (that is, the continuous portion 83A on the inner circumferential surface of the inner circumferential wall 83) of the inside housing 81. In addition, each of the protection members 115 extends upwards along the continuous portion 83A, is bent at the lower circumferential edge portion 116 (i.e., the portion which comprises the lower circumferential edge of the inner passage opening 89), and then extends to the rear inside the inner passage opening 89 and the cut-out portion 96 of the developer seal 92.

In this state, the protection members 115 cover the upper end face 110C of the lower circumferential edge portion 110A from the above. As with the first and the second examples, when the inside housing 81 is caused to move towards the closing position relative to the outside housing 82, the protection members 115 according to the third example are provided between the upper end face 110C and the upper contact portion 118 of the outside housing 82. Incidentally, the protection members 115 may be provided integrally on the upper end face 110C of the lower circumferential edge portion 110A or may not be provided integrally thereon.

Compared with a case where the protection members 115 are supported on an outer portion (i.e., an outer circumferential surface of the inner circumferential wall 83) of the inside housing 81, the protection members 115 of the third example are made difficult to strike the outside housing 82 when the inside housing 81 is caused to move relative to the outside housing 82. Thus, it is possible to suppress displacement of the protection members 115. Therefore, it is ensured that the protection members 115 are provided between the upper end face 110C and the outside housing 82 when the inside housing 81 moves relative to the outside housing 82. Accordingly, it makes possible to ensure the protection of the developer seal 92.

(5) FOURTH EXAMPLE

Figure 16A:
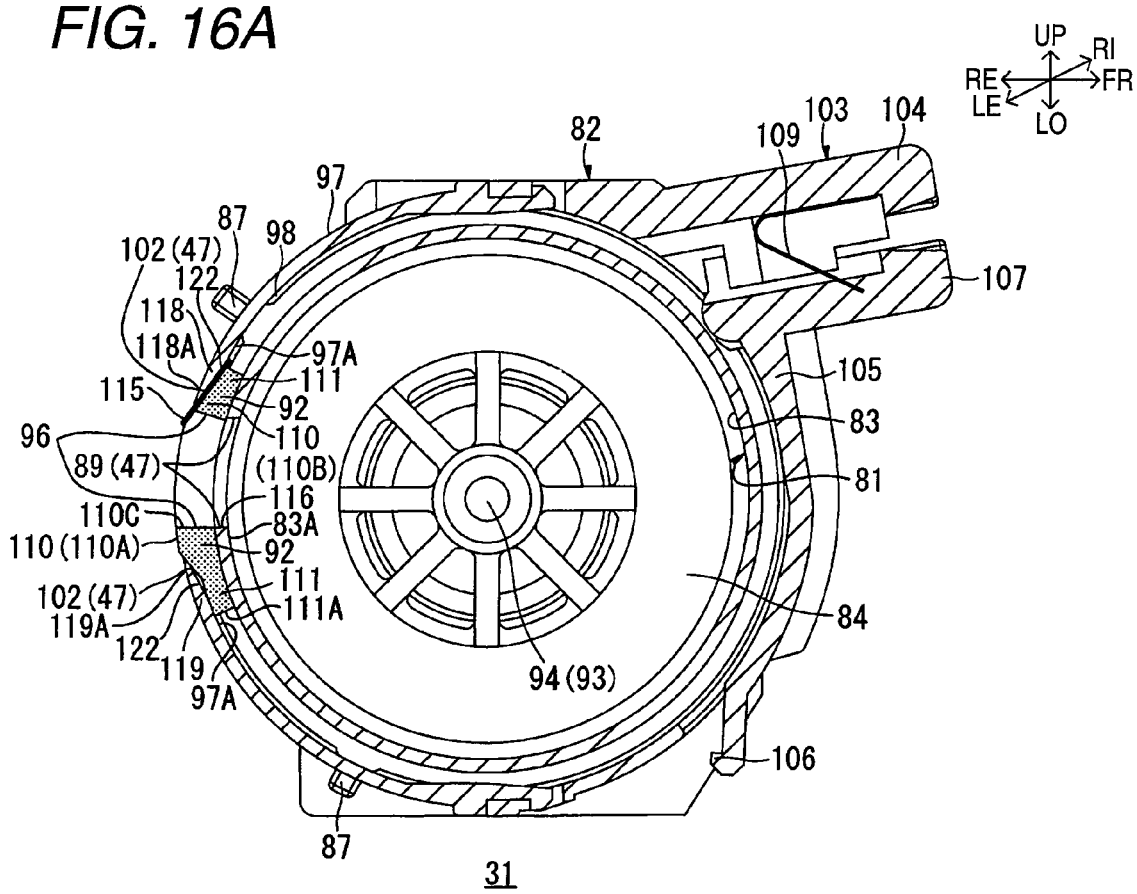
FIGS. 16A and 16B show the developer cartridge, in which a fourth example is applied to FIGS. 12A and 12B.
Figure 16B:
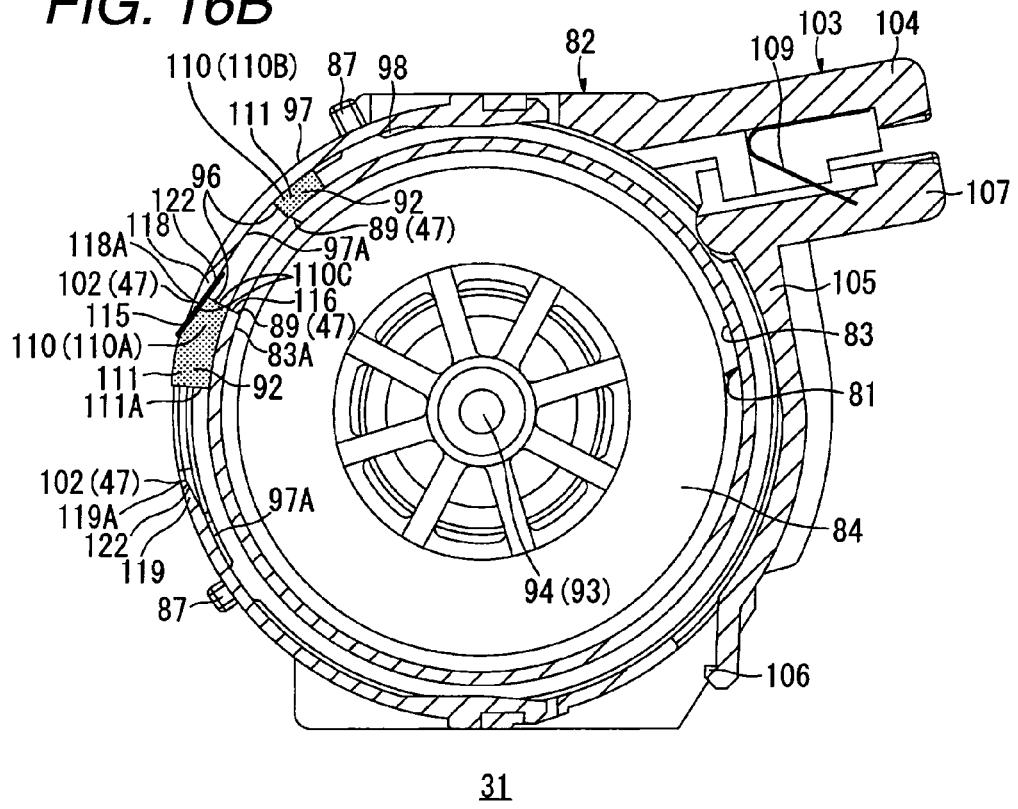

FIGS. 16A and 16B are cross sectional views of the developer cartridge according to a fourth example.

In contrast to the first to third examples where the protection members 115 are provided on the inside housing 81, the protection members 115 according to the fourth example are provided on the outside housing 82. Each of the protection members 115 according to the fourth example is made up of, for example, a PET sheet. Each of the protection members 115 is stuck to the inclined surface 122 on the upper contact portion 118 of the outside housing 82, and then extends obliquely rearwards and downwards along the inclined surface 122. Lower end portions of each of the protection members 115 project from the inclined surface 122 of the upper contact portion 118, extend further obliquely rearwards and downwards, and are then exposed to the outside (i.e., the rear) from the outer passage opening 102 in the outside housing 82.

As with the first to third examples, the protection members 115 according to the fourth example are also provided between the upper end face 110C of the lower circumferential edge portion 110A of the developer seal 92 and the upper contact portion 118 of the outside housing 82 when the inside housing 81 is caused to move from the opening position towards the closing position relative to the outside housing 82 (refer to FIG. 16B).

Incidentally, the protection members 115 may be provided on the inclined surface 122 of the lower contact portion 119 of the outside housing 82.

Modification to Exemplary Embodiments (1) MODIFIED EXAMPLE 1

In the above-described exemplary embodiment, as shown in FIG. 1, the process cartridge 17 integrally has the photoconductive drum 25 and the development roller 37, and the process cartridge 17 is removably mounted in the body casing 2. Alternatively, the process cartridge 17 may be configured such that the developer cartridge is not provided with the photoconductive drum 25, while another unit (i.e., drum cartridge) having the photoconductive drum 25 is provided, to removably mount the developer cartridge to this drum cartridge. Still alternatively, only the developer cartridge 31 may be configured to be removable in a state in which the process cartridge 17 is kept mounted in the body casing 2.

Further, the body casing 2 may include the photoconductive drum 25, the scorotron-type charger 26, and the transfer roller 28, and the developer cartridge may be removably mounted in that body casing 2. In such a configuration, the developer cartridge 31 is removably mounted to the developing cartridge, and a shutter 68 is provided in the developing cartridge.

(2) MODIFIED EXAMPLE 2

Although exemplary embodiments of the present inventive concept have been described in relation to a laser printer, the present inventive concept is not limited to a monochrome laser printer. Rather, the present inventive concept can also be applied to a color laser printer, including a tandem type and an intermediate transfer type printer.

(3) MODIFIED EXAMPLE 3

In the above-described exemplary embodiments, the inside housing 81 is accommodated in the outside housing 82, and the inside housing 81 is made to rotate between the opening position and the closing position, so that the inner passage openings 89 formed in the inside housing 81 are opened and closed.

The outside housing 82 is configured to have a hollow body shape. Alternatively, the outside housing 82 may be configured to have a plate shape, which is similar to the shutter 68 (refer to FIGS. 2A, 2B and 6).

Further, referring to FIGS. 2A and 2B, while the outside housing 82 functions as an example of a first frame and the inside housing 81 functions as an example of a second frame in the above-identified exemplary embodiments, the outside housing 82 may function as an example of a first frame and the inside housing 81 may function as an example of a first frame. In such a configuration, the outer passage openings 102 function as an example of an opening, the developer seals 92 are stuck to the inner circumferential surface of the outer circumferential wall 97 of the outside housing 82 in such a manner as to surround the outer passage openings 102 to which the cut-out portions 96 correspond, so as to prevent the leakage of the developer from the outer passage openings 102. In this case, it is preferable to provide the protection members 115 (refer to FIGS. 13A and 13B) on the outside housing 82 (i.e., the developer seal 92 stuck to the outside housing 82) rather than the inside housing 81 side.

According to another aspect of the invention, in the developer cartridge, wherein the protection member is integrally provided on the seal side confronting portion.

According thereto, since the protection member is provided integrally on the seal side confronting portion, the protection member is provided between the seal side confronting portion and the first frame in an ensured fashion when the second frame moves relative to the first frame, thereby ensuring that the contact of the seal side confronting portion with the first frame is prevented when the second frame moves relative to the first frame. Namely, the protection member can protect the seal member in the ensured fashion.

According to still another aspect of the invention, in the developer cartridge, wherein the protection member is a surface portion of the seal member having a density higher than a density of an interior portion of the seal member.

According thereto, the protection member is the surface portion of the seal member whose density is increased (which is made relatively hard) compared with that of the interior portion thereof. Namely, with the seal member that has been described, by the use of the surface portion as the protection member, the necessity can be obviated of providing separately an additional protection member. Therefore, it makes possible to reduce a number of components.

According to still another aspect of the invention, in the developer cartridge, wherein the projection member comprises a resin layer that coats a surface of the seal member.

According thereto, the projection member is the resin layer which coats the surface of the seal member. Namely, the protection member can be provided integrally on the seal side confronting portion by the relatively simple work in which the surface of the seal member is coated.

According to still another aspect of the invention, in the developer cartridge, wherein the first frame is provided on an outside of the second frame, and wherein the protection member is supported on an inner portion of the second frame.

According thereto, in such a state that the first frame is provided on the outside of the second frame, the protection member is supported on the inner portion of the second frame. Thus, compared with a case where the protection member is supported on an outer portion of the second frame, the protection member is made difficult to strike the first frame. Therefore, the position shift of the protection member is made difficult to take place. By this configuration, the protection member is provided between the seal side confronting portion and the first frame in an ensured fashion when the second frame moves relative to the first frame, thereby making it possible to project the seal member in an ensured fashion.

According to still another aspect of the invention, in the developer cartridge, wherein the first frame comprises a first frame confronting portion that confronts the seal side confronting portion when the second frame moves relative to the first frame, and wherein at least one of the seal side confronting portion and the first frame side confronting portion comprises an inclined surface.

According thereto, the inclined surface is formed at least either of the seal side confronting portion and the first frame side confronting portion which confronts the seal side confronting portion on the first frame. Thus, when the second frame moves relative to the first frame, the seal side confronting portion and the first frame side confronting portion can be brought into moderate contact with each other on at least the inclined surface formed on either of the confronting portions. Therefore, even though the seal side confronting portion and the first frame side confronting portion are brought into contact with each other, the damage of the seal member at the seal side confronting portion can be prevented.

In addition, since the seal side confronting portion and the first frame side confronting portion are brought into moderate contact with each other at the inclined surface, for example, in a case where the first frame is provided on the outside of the second frame, when the second frame moves relative to the first frame, the seal member can be prevented from being caught on the first frame at the seal side confronting portion, and hence, the seal member can move smoothly into the inside of the first frame.

According to still another aspect of the invention, in the developer cartridge, wherein the first frame is provided outside of the second frame.

According to still another aspect of the invention, in the developer cartridge, wherein the first frame is provided outside of the second frame, and wherein the protection member is stuck in such a manner as to extend from the seal side confronting portion to the second frame while a tension is applied to the protection member.

According thereto, while the first frame is provided on the outside of the second frame, the protection member is stuck to extend from the seal side confronting portion to the second frame with a tension applied thereto so as to have a rounded shape. Thus, when the second frame moves relative to the first frame, the seal member can be prevented from being caught on the first frame at the seal side confronting portion. Therefore, the seal member can move smoothly into the inside of the first frame.

What is claimed is:

1. A developer cartridge comprising:

a first frame; and a second frame, which confronts the first frame, and which comprises:

an opening, which is configured to pass developer therethrough, and which is openable and closable by the first frame in accordance with a relative movement between the second frame and the first frame;

a seal member, which is provided around the opening for preventing leakage of the developer from the opening, and which comprises a seal side confronting portion configured to confront the first frame when the second frame moves relative to the first frame; and a protection member, which has an elastic modulus higher than an elastic modulus of the seal member, and which is provided between the seal side confronting portion of the seal member and the first frame and is integrally provided on the seal side confronting portion, the protection member configured to protect the seal member.

2. The developer cartridge according to claim 1, wherein the protection member is a surface portion of the seal member having a density higher than a density of an interior portion of the seal member.

3. The developer cartridge according to claim 1, wherein the protection member comprises a resin layer that coats a surface of the seal member.

4. The developer cartridge according to claim 1, wherein the first frame is provided on an outside of the second frame, and wherein the protection member is supported on an inner portion of the second frame.

5. The developer cartridge according to claim 1, wherein the first frame comprises a first frame confronting portion configured to confront the seal side confronting portion when the second frame moves relative to the first frame, and wherein at least one of the seal side confronting portion and the first frame side confronting portion comprises an inclined surface.

6. The developer cartridge according to claim 1, wherein the first frame is provided outside of the second frame.

7. A developer cartridge comprising:

a first frame; and a second frame, which confronts the first frame, and which comprises:

an opening, which is configured to pass developer therethrough, and which is openable and closable by the first frame in accordance with a relative movement between the second frame and the first frame;

a seal member, which is provided around the opening for preventing leakage of the developer from the opening, and which comprises a seal side confronting portion configured to confront the first frame when the second frame moves relative to the first frame; and a protection member, which has an elastic modulus higher than an elastic modulus of the seal member, and which is provided between the seal side confronting portion of the seal member and the first frame and is integrally provided on the seal side confronting portion, the protection member configured to protect the seal member, wherein the first frame is provided outside of the second frame, and wherein the protection member is configured to extend from the seal side confronting portion to the second frame while a tension is applied to the protection member.

8. A developing unit comprising:

a developer cartridge comprising:

a first frame; and a second frame, which confronts the first frame, and which comprises:

an opening, which is configured to pass developer therethrough, and which is openable and closable by the first frame in accordance with a relative movement between the second frame and the first frame;

a seal member, which is provided around the opening for preventing leakage of the developer from the opening, and which comprises a seal side confronting portion configured to confront the first frame when the second frame moves relative to the first frame; and a protection member, which has an elastic modulus higher than an elastic modulus of the seal member, and which is provided between the seal side confronting portion of the seal member and the first frame and is integrally provided on the seal side confronting portion, the protection member configured to protect the seal member, wherein the developing unit visualizes an electrostatic latent image with the developer in the developer cartridge.

9. An image forming apparatus comprising:

a developer cartridge comprising:

a first frame; and a second frame, which confronts the first frame, and which comprises:

an opening, which is configured to pass developer therethrough, and which is openable and closable by the first frame in accordance with a relative movement between the second frame and the first frame;

a seal member, which is provided around the opening for preventing leakage of the developer from the opening, and which comprises a seal side confronting portion configured to confront the first frame when the second frame moves relative to the first frame; and a protection member, which has an elastic modulus higher than an elastic modulus of the seal member, and which is provided between the seal side confronting portion of the seal member and the first frame and is integrally provided on the seal side confronting portion, the protection member configured to protect the seal member; and an image forming apparatus main body to which the developer cartridge is mounted.

10. A developing unit comprising:

a developer cartridge comprising:

a first frame; and a second frame, which confronts the first frame, and which comprises:

an opening, which is configured to pass developer therethrough, and which is openable and closable by the first frame in accordance with a relative movement between the second frame and the first frame;

a seal member, which is provided around the opening for preventing leakage of the developer from the opening, and which comprises a seal side confronting portion configured to confront the first frame when the second frame moves relative to the first frame; and a protection member, which has an elastic modulus higher than an elastic modulus of the seal member, and which is provided between the seal side confronting portion of the seal member and the first frame and is integrally provided on the seal side confronting portion, the protection member configured to protect the seal member, wherein the first frame is provided outside of the second frame, wherein the protection member is configured to extend from the seal side confronting portion to the second frame while a tension is applied to the protection member, and wherein the developing unit visualizes an electrostatic latent image with the developer in the developer cartridge.

11. An image forming apparatus comprising:

a developer cartridge comprising:

a first frame; and a second frame, which confronts the first frame, and which comprises:

an opening, which is configured to pass developer therethrough, and which is openable and closable by the first frame in accordance with a relative movement between the second frame and the first frame;

a seal member, which is provided around the opening for preventing leakage of the developer from the opening, and which comprises a seal side confronting portion configured to confront the first frame when the second frame moves relative to the first frame; and a protection member, which has an elastic modulus higher than an elastic modulus of the seal member, and which is provided between the seal side confronting portion of the seal member and the first frame and is integrally provided on the seal side confronting portion, the protection member configured to protect the seal member; and an image forming apparatus main body to which the developer cartridge is mounted, wherein the first frame is provided outside of the second frame, and wherein the protection member is configured to extend from the seal side confronting portion to the second frame while a tension is applied to the protection member.

* * * * *